US006475687B2

(12) United States Patent
Hayashi et al.

(10) Patent No.: US 6,475,687 B2
(45) Date of Patent: Nov. 5, 2002

(54) MAGNETIC COMPOSITE PARTICLES FOR BLACK MAGNETIC TONER AND BLACK MAGNETIC TONER USING THE SAME

(75) Inventors: Kazuyuki Hayashi, Hiroshima (JP); Yusuke Shimohata, Hiroshima (JP); Keisuke Iwasaki, Hiroshima (JP); Hiroko Morii, Hiroshima (JP)

(73) Assignee: Toda Kogyo Corporation, Hiroshima-ken (JP)

( * ) Notice: Subject to any disclaimer, the term of this patent is extended or adjusted under 35 U.S.C. 154(b) by 0 days.

(21) Appl. No.: 09/887,512

(22) Filed: Jun. 25, 2001

(65) Prior Publication Data

US 2002/0031713 A1 Mar. 14, 2002

(30) Foreign Application Priority Data

Jun. 26, 2000 (JP) ..... 2000-191788

(51) Int. Cl.[7] ..... G03G 9/00

(52) U.S. Cl. ..... 430/106.2; 430/106.1; 430/111.4; 430/137.18; 428/407; 427/127

(58) Field of Search ..... 430/106.2, 106.1, 430/111.4, 137.18; 428/407; 427/127

(56) References Cited

U.S. PATENT DOCUMENTS

2002/0045700 A1 * 4/2002 Hayashi et al. ..... 524/588

FOREIGN PATENT DOCUMENTS

EP 0 936 507 A2 8/1999
WO WO 93/23795 11/1993

OTHER PUBLICATIONS

DataBase WPI Section Ch, Week 199028 Derwent Class G01, AN 1990–214711 XP002178979 JP 146059 Jun. 1990 Abstract.

* cited by examiner

*Primary Examiner*—Mark Chapman
(74) *Attorney, Agent, or Firm*—Nixon & Vanderhye P.C.

(57) ABSTRACT

Magnetic composite particles having an average particle diameter of 0.06 to 1.0 $\mu$m and a coercive force value of less than 39.790 kA/m, comprising:

magnetic core particles, a coating formed on surface of said magnetic core particles, comprising at least one organosilicon compound selected from the group consisting of:

(1) organosilane compounds obtainable from alkoxysilane compounds, and (2) polysiloxanes or modified polysiloxanes, and an organic blue-based pigment coat formed on said coating layer comprising said organosilicon compound, in an amount of from 1 to 50 parts by weight based on 100 parts by weight of said magnetic core particles.

The magnetic composite particles are suitable for black magnetic toner not only exhibiting a deep black color but also having excellent light resistance and fluidity.

28 Claims, No Drawings

MAGNETIC COMPOSITE PARTICLES FOR BLACK MAGNETIC TONER AND BLACK MAGNETIC TONER USING THE SAME

BACKGROUND OF THE INVENTION

The present invention relates to magnetic composite particles for black magnetic toner and a black magnetic toner using the magnetic composite particles, and more particularly, to magnetic composite particles for black magnetic toner not only exhibiting a deep black color but also having excellent light resistance and fluidity, and a black magnetic toner produced by using the magnetic composite particles, which not only exhibits a deep black color but also has excellent light resistance and fluidity.

As recent image development systems, there are mainly known one-component development system requiring no carrier, and two-component development system using both a black toner and a carrier. In the two-component development system, the black toner is brought into frictional contact with the carrier so as to apply thereto an electrostatic charge reverse to that of an electrostatic latent image formed on a photosensitive member, whereby the black toner is adhered onto the latent image by electrostatic attraction force such that the reverse-sign charge thereof is neutralized. As such magnetic toner, there have been extensively used composite particles obtained by mixing and dispersing magnetic particles such as magnetite particles in resin.

With recent tendency toward high image quality such as high image density and good color gradient as well as high copying speed of copying machines, it has been strongly required to improve properties of the magnetic toner.

Namely, the magnetic toner has been required to form line images and solid area images having a good blackness, i.e., a high density when developed therewith.

As to this fact, at page 272 of "Comprehensive Technical Data for Development and Utilization of Toner Materials" published by Nippon Science Information Co., Ltd., it is described that "although it is a feature of the powder behavior that the image density is high, the high image density considerably influences not only fog concentration but also image properties as described later".

Also, the magnetic toner has been strongly required to show improved properties, especially high fluidity.

As to this fact, in Japanese Patent Application Laid-Open (KOKAI) No. 53-94932(1978), it is described that "such high-resistant magnetic toner exhibits a poor fluidity due to its high resistance and, therefore, tends to undergo problems such as non-uniform development. This is, although the high-resistant magnetic toner for PPC can retain a sufficient charge for the transfer of toner image, the magnetic toner tends to be agglomerated together at steps other than the transfer step, e.g., inside toner bottle or on the surface of magnetic roll, by a slight amount of electrostatic charge thereon generated by frictional electrification or by mechanoelectret, etc. used in the toner production process, resulting in its poor fluidity", and that "Another object of the present invention is to provide a high-resistant magnetic toner for PPC exhibiting an improved fluidity, thereby obtaining indirect copies which are free from non-uniform development and excellent in definition and color gradient".

Further, with recent tendency toward reduction in particle size of the magnetic toner, it has been more strongly required to improve the fluidity thereof.

As to this fact, at page 121 of the above "Comprehensive Technical Data for Development and Utilization of Toner Materials", it is described that "Widespread printers such as ICP have been required to provide high-quality printed images. In particular, it has been required to develop printers capable of forming images with high-definition and high-accuracy. As apparent from Table 1 showing a relationship between various toners and definitions of images obtained using the respective toners, the wet toner having a smaller particle size can form higher-definition images. Also, in order to enhance the definition of images obtained by a dry toner, the reduction in particle size of these toners is required. . . . As to toners having a small particle size, for example, there has been such a report that the use of a toner having a particle size of 8.5 to 11 $\mu$m inhibits the generation of fog in background area and reduces the amount of toner consumed, and further the use of a polyester-based toner having a particle size of 6 to 10 $\mu$m results in high image quality, stable electrostatic charge and prolonged service life of developer. However, such toners having a small particle size have many problems to be solved upon use, such as productivity, sharpness of particle size distribution, improvement in fluidity . . . or the like".

In addition, since recording papers having printed images developed with the magnetic toner are usually used or preserved for a long period of time after printing, the magnetic toner is required to have an excellent light resistance in order to keep clear printed images.

The properties of the magnetic toner have a close relationship with those of magnetic particles mixed and dispersed therein. In particular, it is known that the magnetic particles and the like exposed to the surface of the magnetic toner considerably influence-developing characteristics of the magnetic toner.

Namely, the blackness and density of the magnetic toner largely varies depending upon those of the magnetic particles incorporated as a black pigment into the magnetic toner.

As the black pigment, magnetite particles have been extensively used from the standpoints of good magnetic properties such as saturation magnetization and coercive force, low price, suitable color tone or the like. However, the magnetite particles are insufficient in blackness required for the magnetic toner. Therefore, the magnetite particles tend to be frequently used together with fine carbon black particles. However, the carbon black fine particles also act as an electric resistance-controlling agent. For this reason, it is known that when a large amount of the carbon black fine particles are added to enhance the blackness of the magnetic toner, the volume resistivity of the magnetic toner is reduced to less than $1\times10^{13}$ $\Omega\cdot$cm, thereby failing to provide an insulating or high-resistant magnetic toner.

Therefore, it has been required to provide magnetic particles having a sufficient blackness compatible with carbon black contained in the conventional magnetic toner.

On the other hand, the fluidity of the magnetic toner also largely varies depending on the surface conditions of the magnetic particles exposed to the surface of the magnetic toner. Therefore, the magnetic particles themselves have been required to show an excellent fluidity.

Further, since the light resistance of the magnetic toner also varies depending upon properties of the magnetic particles contained therein, it has been required to enhance the light resistance of the magnetic particles themselves.

Various methods have been conventionally attempted in order to enhance the blackness of the magnetite particles mixed and dispersed in the magnetic toner, thereby improving the blackness of the magnetic toner. For example, there have been proposed (1) a method of coating the surfaces of magnetic iron oxide particles with organosilane compounds obtained from alkoxysilane, and then adhering carbon black on the coating of organosilane compounds (Japanese Patent Application Laid-Open (KOKAI) No. 11-305480(1999), etc.); (2) a method of coating the surfaces of magnetic particles with a colorant through a coupling agent (Japanese Patent Application Laid-Open (KOKAI) No. 60-26954 (1985)); (3) a method of tinting magnetic particles with dyes (Japanese Patent Application Laid-Open (KOKAI) No. 59-57249(1984)); or the like.

At present, it has been strongly required to provide magnetic composite particles for black magnetic toner exhibiting not only a deep black color but also excellent light resistance and fluidity. However, such magnetic composite particles have not been obtained.

That is, the magnetic particles described in Japanese Patent Application Laid-Open (KOKAI) No. 11-305480 (1999) fail to show a deep black color as described in Comparative Examples below.

The method described in Japanese Patent Application Laid-Open (KOKAI) No. 60-26954(1985) has aimed at the production of color toner for full color images having a good hue. Therefore, there is silent at all to obtain the black toner having a deep black color, and the black toner fails to show a deep black color.

In addition, in the method described in Japanese Patent Application Laid-Open (KOKAI) No. 59-57249(1984), the magnetite particles are tinted with dyes. Therefore, the obtained particles also fail to show a sufficient light resistance as described in Comparative Examples below.

As a result of the present inventors' earnest studies, it has been found that by mixing magnetic core particles with at least one compound selected from the group consisting of:
(1) alkoxysilane compounds, and
(2) polysiloxanes or modified polysiloxanes, by using an apparatus capable of applying a shear force to the magnetic core particles, thereby coating the surface of the magnetic core particle with the said compounds; and mixing the obtained magnetic core particles coated with the said compounds and an organic blue-based pigment in an amount of 1 to 50 parts by weight based on 100 parts by weight of the magnetic core particles by using an apparatus capable of applying a shear force to the magnetic core particles coated with the said compounds, thereby forming an organic blue-based pigment coat on the surface of a coating layer comprising the organosilicon compounds, the obtained magnetic composite particles can exhibit not only a deep black color, but also excellent light resistance and fluidity. The present invention has been attained on the basis of the finding.

SUMMARY OF THE INVENTION

An object of the present invention is to provide magnetic composite particles which are not only excellent in fluidity, light resistance and deep black color, but also can show an excellent dispersibility in a binder resin.

Another object of the present invention is to provide a black magnetic toner exhibiting not only a deep black color but also excellent fluidity and light resistance.

To accomplish the aims, in a first aspect of the present invention, there are provided magnetic composite particles having an average particle diameter of 0.06 to 1.0 μm and a coercive force value of less than 39.790 kA/m (500 Oe), comprising:

magnetic core particles, a coating formed on surface of the said magnetic core particles, comprising at least one organosilicon compound selected from the group consisting of:
(1) organosilane compounds obtainable from alkoxysilane compounds, and
(2) polysiloxanes or modified polysiloxanes, and an organic blue-based pigment coat formed on the said coating layer comprising the said organosilicon compound, in an amount of from 1 to 50 parts by weight based on 100 parts by weight of the said magnetic core particles.

In a second aspect of the present invention, there are provided magnetic composite particles having an average particle diameter of 0.06 to 1.0 μm and a coercive force value of less than 39.790 kA/m (500 Oe), comprising:

magnetite particles, a coating formed on surface of the said magnetite particles, comprising at least one organosilicon compound selected from the group consisting of:
(1) organosilane compounds obtainable from alkoxysilane compounds, and
(2) polysiloxanes or modified polysiloxanes, and an organic blue-based pigment coat formed on the said coating layer comprising the said organosilicon compound, in an amount of from 1 to 50 parts by weight based on 100 parts by weight of the said magnetite particles.

In a third aspect of the present invention, there are provided magnetic composite particles having an average particle diameter of 0.06 to 1.0 μm and a coercive force value of less than 39.790 kA/m (500 Oe), comprising:

(a) black magnetic composite particles precursor comprising:
(i) magnetic iron oxide particles;
(ii) a coating formed on the surface of the said magnetic iron oxide particles, comprising at least one organosilicon compound selected from the group consisting of:
(1) organosilane compounds obtainable from alkoxysilane compounds, and
(2) polysiloxanes or modified polysiloxanes, and
(iii) a carbon black coat formed on at least a part of the surface of the said coating layer comprising the said organosilicon compound, in an amount of 1 to 25 parts by weight based on 100 parts by weight of the said magnetic iron oxide particles;

(b) a coating formed on surface of the said black magnetic composite particles precursor, comprising at least one organosilicon compound selected from the group consisting of:
(1) organosilane compounds obtainable from alkoxysilane compounds, and
(2) polysiloxanes or modified polysiloxanes; and (c) an organic blue-based pigment coat formed on the said coating layer comprising the said organosilicon compound, in an amount of from 1 to 50 parts by weight based on 100 parts by weight of the said black magnetic composite particles precursor.

In a fourth aspect of the present invention, there is provided a process for producing the said magnetic composite particles defined in the first aspect, which process comprises:

mixing magnetic core particles together with at least one compound selected from the group consisting of:

(1) alkoxysilane compounds, and (2) polysiloxanes or modified polysiloxanes, by using an apparatus capable of applying a shear force to the magnetic core particles, thereby coating the surface of the said magnetic core particle with the said compounds;

mixing the obtained magnetic core particles coated with the said compounds and an organic blue-based pigments in an amount of 1 to 50 parts by weight based on 100 parts by weight of the magnetic core particles by using an apparatus capable of applying a shear force to the magnetic core particles coated with the said compound, thereby forming an organic blue-based pigments coat on the surface of a coating layer comprising the organosilicon compounds.

In a fifth aspect of the present invention, there is provided a black magnetic toner comprising:

a binder resin, and magnetic composite particles having an average particle diameter of 0.06 to 1.0 μm and a coercive force value of less than 39.790 kA/m (500 Oe), comprising:

magnetic core particles, a coating formed on surface of the said magnetic core particles, comprising at least one organosilicon compound selected from the group consisting of:

(1) organosilane compounds obtainable from alkoxysilane compounds, and (2) polysiloxanes or modified polysiloxanes, and an organic blue-based pigment coat formed on the said coating layer comprising the said organosilicon compound, in an amount of from 1 to 50 parts by weight based on 100 parts by weight of the said magnetic core particles.

In a sixth aspect of the present invention, there is provided a black magnetic toner comprising:

a binder resin, and magnetic composite particles having an average particle diameter of 0.06 to 1.0 μm and a coercive force value of less than 39.790 kA/m (500 Oe), comprising:

magnetite particles, a coating formed on surface of the said magnetite particles, comprising at least one organosilicon compound selected from the group consisting of:

(1) organosilane compounds obtainable from alkoxysilane compounds, and (2) polysiloxanes or modified polysiloxanes, and an organic blue-based pigment coat formed on the said coating layer comprising the said organosilicon compound, in an amount of from 1 to 50 parts by weight based on 100 parts by weight of the said magnetite particles.

In a seventh aspect of the present invention, there is provided a black magnetic toner comprising:

a binder resin, and magnetic composite particles having an average particle diameter of 0.06 to 1.0 μm and a coercive force value of less than 39.790 kA/m (500 Oe), comprising:

(a) black magnetic composite particles precursor comprising:

(i) magnetic iron oxide particles;

(ii) a coating formed on the surface of the said magnetic iron oxide particles, comprising at least one organosilicon compound selected from the group consisting of:

(1) organosilane compounds obtainable from alkoxysilane compounds, and (b 2) polysiloxanes or modified polysiloxanes, and (iii) a carbon black coat formed on at least a part of the surface of the said coating layer comprising the said organosilicon compound, in an amount of 1 to 25 parts by weight based on 100 parts by weight of the said magnetic iron oxide particles;

(b) a coating formed on surface of the said black magnetic composite particles precursor, comprising at least one organosilicon compound selected from the group consisting of:

(1) organosilane compounds obtainable from alkoxysilane compounds, and (2) polysiloxanes or modified polysiloxanes; and (c) an organic blue-based pigment coat formed on the said coating layer comprising the said organosilicon compound, in an amount of from 1 to 50 parts by weight based on 100 parts by weight of the said black magnetic composite particles precursor.

In an eighth aspect of the present invention, there are provided magnetic composite particles comprising:

magnetic core particles, a coating formed on surface of the said magnetic core particles, comprising at least one organosilicon compound selected from the group consisting of:

(1) organosilane compounds obtainable from alkoxysilane compounds, and (2) polysiloxanes or modified polysiloxanes, and an organic blue-based pigment coat formed on the said coating layer comprising the said organosilicon compound, in an amount of from 1 to 50 parts by weight based on 100 parts by weight of the said magnetic core particles; and having an average particle diameter of 0.06 to 1.0 μm, a BET specific surface area value of 1.0 to 100 $m^2/g$, a geometrical standard deviation of major axis diameter of 1.01 to 2.0, a L* value of 2.0 to 13.5, an a* value of −2.0 to 0.0, a b* value of −3.0 to 5.5, and a coercive force value of less than 39.790 kA/m (500 Oe).

In a ninth aspect of the present invention, there is provided a black magnetic toner comprising:

a binder resin, and magnetic composite particles having an average particle diameter of 0.06 to 1.0 μm and a coercive force value of less than 39.790 kA/m (500 Oe), comprising:

magnetic core particles, a coating formed on surface of the said magnetic core particles, comprising at least one organosilicon compound selected from the group consisting of:

(1) organosilane compounds obtainable from alkoxysilane compounds, and (2) polysiloxanes or modified polysiloxanes, and an organic blue-based pigment coat formed on the said coating layer comprising the said organosilicon compound, in an amount of from 1 to 50 parts by weight based on 100 parts by weight of the said magnetic core particles; and having an average particle size of 3 to 15 μm, a flowability index of 70 to 100, a volume resistivity of not less than $1.0\times10^{13}$ Ω·cm, a blackness (L* value) of 2.0 to 13.5, an a* value of −2.0 to 0.0, a b* value of −3.0 to 5.5, a light resistance (ΔE* value) of not more than 5.0, and a coercive force value of less than 39.790 kA/m (500 Oe).

In a tenth aspect of the present invention, there are provided magnetic composite particles having an average particle diameter of 0.06 to 1.0 μm and a coercive force value of less than 39.790 kA/m (500 Oe), comprising:

magnetite particles, wherein said magnetite particles are particles having a coat formed on at least a part of the surface of said magnetite particles and which comprises at least one compound selected from the group consisting of hydroxides of aluminum, oxides of aluminum, hydroxides of silicon and oxides of silicon in an amount of 0.01 to 20% by weight, calculated as Al or $SiO_2$, based on the total weight of the magnetite particles coated, a coating formed on surface of the said magnetite particles, comprising at least one organosilicon compound selected from the group consisting of:

(1) organosilane compounds obtainable from alkoxysilane compounds, and (2) polysiloxanes or modified polysiloxanes, and an organic blue-based pigment coat formed on the said coating layer comprising the said organosilicon compound, in an amount of from 1 to 50 parts by weight based on 100 parts by weight of the said magnetite particles.

In an eleventh aspect of the present invention, there are provided magnetic composite particles having an average particle diameter of 0.06 to 1.0 μm and a coercive force value of less than 39.790 kA/m (500 Oe), comprising:

(a) black magnetic composite particles precursor comprising:

(i) magnetic iron oxide particles, wherein said magnetic iron oxide particles are particles having a coat formed on at least a part of the surface of said magnetic iron oxide particles and which comprises at least one compound selected from the group consisting of hydroxides of aluminum, oxides of aluminum, hydroxides of silicon and oxides of silicon in an amount of 0.01 to 20% by weight, calculated as Al or $SiO_2$, based on the total weight of the magnetic iron oxide particles coated;

(ii) a coating formed on the surface of the said magnetic iron oxide particles, comprising at least one organosilicon compound selected from the group consisting of:

(1) organosilane compounds obtainable from alkoxysilane compounds, and (2) polysiloxanes or modified polysiloxanes, and (iii) a carbon black coat formed on at least a part of the surface of the said coating layer comprising the said organosilicon compound, in an amount of 1 to 25 parts by weight based on 100 parts by weight of the said magnetic iron oxide particles;

(b) a coating formed on surface of the said black magnetic composite particles precursor, comprising at least one organosilicon compound selected from the group consisting of:

(1) organosilane compounds obtainable from alkoxysilane compounds, and (2) polysiloxanes or modified polysiloxanes; and (c) an organic blue-based pigment coat formed on the said coating layer comprising the said organosilicon compound, in an amount of from 1 to 50 parts by weight based on 100 parts by weight of the said black magnetic composite particles precursor.

DETAILED DESCRIPTION OF THE INVENTION

The present invention will be described in detail below.

The magnetic composite particles of the present invention are black magnetic particles comprising magnetic core particles, a coating layer formed on the surface of each magnetic core particle which comprises organosilane compounds obtained from alkoxysilanes or polysiloxanes, and an organic blue-based pigment adhered on a part of the coating layer; and having an average particle size of 0.06 to 1.0 μm and a coercive force value of less than 39.790 kA/m (500 Oe).

As the magnetic core particles, there may be used (A) magnetite particles ($\underline{FeO_x}\cdot Fe_2O_3$; $0<x\leqq 1$), and (B) black magnetic composite particles precursor comprising the magnetic iron oxide particles such as magnetite particles ( $\underline{FeO_x}\cdot Fe_2O_3$; $0<x\leqq 1$), maghemite particles ($\gamma$—$Fe_2O_3$) or a mixture of these particles, an organosilicon compound coating layer formed on the surface of each magnetic iron oxide particle, and a carbon black coat formed on the coating layer.

In the consideration of blackness of the obtained magnetic composite particles, it is preferred that as the magnetic core particles the black magnetic composite particles precursor (B) comprising the magnetic iron oxide particles, the organosilicon compound coating layer formed on the surface of each magnetic iron oxide particle, and the carbon black coat formed on the coating layer is used.

First, the magnetite particles (A) are described.

The magnetite particles (A) as the magnetic core particles may be either isotropic particles having a ratio of an average major diameter to an average minor diameter (hereinafter referred to merely as "sphericity") of usually not less than 1.0:1 and less than 2.0:1, such as spherical particles, granular particles or polyhedral particles, e.g., hexahedral particles or octahedral particles, or anisotropic particles having a ratio of an average major axial diameter to an average minor axial diameter (hereinafter referred to merely as "aspect ratio") of not less than 2.0:1, such as acicular particles, spindle-shaped particles or rice ball-shaped particles. In the consideration of the fluidity of the obtained magnetic composite particles, the magnetite particles having an isotropic shape are preferred. Among them, the spherical particles are more preferred. The sphericity of the spherical particles is preferably 1.0:1 to 1.4:1, more preferably 1.0:1 to 1.3:1.

The magnetite particles as the magnetic core particles have an average particle size (average major axial diameter in the case of anisotropic particles) of 0.055 to 0.95 μm, preferably 0.065 to 0.75 μm, more preferably 0.065 to 0.45 μm.

When the average particle size of the magnetite particles is more than 0.95 μm, the obtained magnetic composite particles are coarse particles and are deteriorated in tinting strength.

On the other hand, when the average particle size is too small, the agglomeration of the particles tends to be caused. As a result, it becomes difficult to uniformly coat the surfaces of the magnetite particles with the alkoxysilanes or polysiloxanes, and uniformly adhere the organic blue-based pigment on the surface of the coating layer comprising the alkoxysilanes or polysiloxanes.

When the magnetite particles as the magnetic core particles have an anisotropic shape, the upper limit of the aspect ratio thereof is preferably 20.0:1, more preferably 18.0:1, still more preferably 15.0:1. When the upper limit of the aspect ratio of the anisotropic magnetite particles exceeds 20.0:1, the particles may tend to be entangled with each other, and it also may become difficult to uniformly coat the surfaces of the magnetite particles with the alkoxysilane or polysiloxanes, and uniformly adhere the organic blue-based pigment on the surface of the coating layer comprising the alkoxysilane or polysiloxanes.

The magnetite particles as the magnetic core particles have a geometrical standard deviation value of particle sizes (major axial diameters in the case of anisotropic particles) of preferably not more than 2.0, more preferably not more than 1.8, still more preferably not more than 1.6. When the geometrical standard deviation value of the magnetite particles is more than 2.0, coarse particles may be contained therein, so that the particles may be inhibited from being uniformly dispersed. As a result, it also may become difficult to uniformly coat the surfaces of the magnetite particles with the alkoxysilanes or polysiloxanes, and uniformly adhere the organic blue-based pigment on the surface of the coating layer comprising the alkoxysilane or polysiloxanes. The lower limit of the geometrical standard deviation value is 1.01. It is industrially difficult to obtain particles having a geometrical standard deviation value of less than 1.01.

The BET specific surface area value of the magnetite particles as the magnetic core particles is usually not less than 0.5 $m^2/g$. When the BET specific surface area is less than 0.5 $m^2/g$, the magnetite particles may become coarse particles, or the sintering within or between the particles may be caused, so that the obtained magnetic composite particles may also become coarse particles and tend to be deteriorated in tinting strength. In the consideration of the tinting strength of the obtained magnetic composite particles, the BET specific surface area of the magnetite particles is preferably not less than 1.0 $m^2/g$, more preferably not less than 1.5 $m^2/g$. Further, in the consideration of uniformly coating the surfaces of the magnetite particles with the alkoxysilane or polysiloxanes, and uniformly adhering the organic blue-based pigment on the surface of the coating layer comprising the alkoxysilane or polysiloxanes, the upper limit of the BET specific surface area of the magnetite particles is usually 95 $m^2/g$, preferably 90 $m^2/g$, more preferably 85 $m^2/g$.

As to the fluidity of the magnetite particles as the magnetic core particles, the fluidity index thereof is about 25 to about 43. Among the magnetite particles having various shapes, the spherical magnetite particles are more excellent in fluidity, for example, the fluidity index thereof is about 30 to about 43.

As to the hue of the magnetite particles as the magnetic core particles, the lower limit of L* value thereof is 7.0, and the upper limit of the L* value is usually about 18.0, preferably about 16.5; the lower limit of a* value thereof is more than 0.0, and the upper limit of the a* value is usually about 7.0, preferably about 6.0; and the lower limit of b* value thereof is −1.0, and the upper limit of the b* value is usually about 6.0, preferably about 5.0. When the L* value exceeds 18.0, the lightness of the particles may be increased, so that it may be difficult to obtain magnetic composite particles having a sufficient blackness. When the a* value exceeds 7.0, the obtained particles may exhibit a reddish color, so that it may be difficult to obtain magnetic composite particles having a deep black color.

As to the light resistance of the magnetite particles as the magnetic core particles, the lower limit of ΔE* value is more than 5.0, and the upper limit thereof is 12.0, preferably 10.0, when measured by the below-mentioned method.

As to the magnetic properties of the magnetite particles as the magnetic core particles, the coercive force value thereof is usually less than 39.790 kA/m (500 Oe), preferably about 0.8 to about 31.8 kA/m (about 10 to about 400 Oe), more preferably about 1.6 to about 30.2 kA/m (about 20 to about 380 Oe); the saturation magnetization value thereof in a magnetic field of 795.8 kA/m (10 kOe) is usually about 50 to about 91 $Am^2/kg$ (about 50 to about 91 emu/g), preferably about 60 to about 90 $Am^2/kg$ (about 60 to about 90 emu/g); and the residual magnetization value thereof in a magnetic field of 795.8 kA/m (10 kOe) is usually about 1 to about 35 $Am^2/kg$ (about 1 to about 35 emu/g), preferably about 3 to about 30 $Am^2/kg$ (about 3 to about 30 emu/g).

The magnetite particle as magnetic core particle may be preliminarily coated with at least one compound selected from the group consisting of hydroxides of aluminum, oxides of aluminum, hydroxides of silicon and oxides of silicon (hereinafter referred to as "hydroxides and/or oxides of aluminum and/or silicon"), if required. The obtained magnetite particles having a coating layer composed of hydroxides and/or oxides of aluminum and/or silicon can more effectively prevent the organic blue-based pigment adhered thereonto from being desorbed therefrom as compared to the case where the magnetite particles are uncoated with hydroxides and/or oxides of aluminum and/or silicon.

The amount of the coating layer composed of hydroxides and/or oxides of aluminum and/or silicon is preferably 0.01 to 20% by weight (calculated as Al, $SiO_2$ or a sum of Al and $SiO_2$) based on the weight of the coated magnetite particles.

When the amount of the coating layer composed of hydroxides and/or oxides of aluminum and/or silicon is less than 0.01% by weight, the effect of preventing the desorption of the organic blue-based pigment may not be obtained. When the amount of the coating layer composed of hydroxides and/or oxides of aluminum and/or silicon falls within the above-specified range of 0.01 to 20% by weight, the effect of preventing the desorption of the organic blue-based pigment can be sufficiently exhibited. Therefore, it is unnecessary and meaningless to form the coating layer composed of hydroxides and/or oxides of aluminum and/or silicon in such a large amount exceeding 20% by weight.

The particle size, geometrical standard deviation value, BET specific surface area value, volume resistivity value, fluidity, hue (L*, a* and b* values), light resistance (ΔE* value) and magnetic properties of the magnetic composite particles comprising the magnetite particles having the coating layer composed of hydroxides and/or oxides of aluminum and/or silicon, are substantially the same as those of the magnetic composite particles comprising the magnetite particles uncoated with the hydroxides and/or oxides of aluminum and/or silicon. The desorption percentage of the organic blue-based pigment from the magnetic composite particles can be reduced by forming the coating layer composed of hydroxides and/or oxides of aluminum and/or silicon on each magnetite particle, and is preferably not more than 12%, more preferably not more than 10%.

Next, the black magnetic composite particles precursor (B) comprising magnetic iron oxide particles such as magnetite particles ($\underline{FeO_x}\cdot Fe_2O_3$; $0<x\leqq 1$), maghemite particles ($\gamma$—$Fe_2O_3$) or a mixture of these particles, an organosilicon compound coating layer formed on the surface of each magnetic iron oxide particle, and a carbon black coat formed on the coating layer, is described below.

The black magnetic composite particles precursor comprise:

magnetic iron oxide particles having an average particle diameter of 0.050 to 0.90 $\mu$m;

a coating formed on the surface of the said magnetic iron oxide particles, comprising at least one organosilicon compound selected from the group consisting of:

(1) organosilane compounds obtainable from alkoxysilane compounds, and (2) polysiloxanes or modified polysiloxanes, and a carbon black coat formed on at least a part of the surface of the said coating layer comprising the said organosilicon compound, in an amount of 1 to 25 parts by weight based on 100 parts by weight of the said magnetic iron oxide particles.

As the magnetic iron oxide particles of the magnetic core particles of the black magnetic composite particles precursor (B), there are used the above magnetite particles ( $FeO_x \cdot Fe_2O_3$; $0<x\leqq 1$), maghemite particles ($\gamma$—$Fe_2O_3$) or a mixture of these particles. The properties of the magnetite particles are substantially the same as those of the magnetite particles (A), except that the an average particle size (average major axial diameter in the case of anisotropic particles) of 0.050 to 0.90 $\mu$m, preferably 0.060 to 0.70 $\mu$m, more preferably 0.060 to 0.40 $\mu$m.

The coating formed on the surface of the magnetic core particle (magnetic iron oxide particle) comprises at least one organosilicon compound selected from the group consisting of (1) organosilane compounds obtainable from alkoxysilane compounds; and (2) polysiloxanes and modified polysiloxanes selected from the group consisting of (2-A) polysiloxanes modified with at least one compound selected from the group consisting of polyethers, polyesters and epoxy compounds (hereinafter referred to merely as "modified polysiloxanes"), and (2-B) polysiloxanes whose molecular terminal is modified with at least one group selected from the group consisting of carboxylic acid groups, alcohol groups and a hydroxyl group (hereinafter referred to merely as "terminal-modified polysiloxanes").

The organosilane compounds (1) may be produced from alkoxysilane compounds represented by the formula (I):

$$R^1_aSiX_{4-a} \qquad \text{(I)}$$

wherein $R^1$ is $C_6H_5$—, $(CH_3)_2CHCH_2$— or n—$C_bH_{2b+1}$— (wherein b is an integer of 1 to 18); X is $CH_3O$— or $C_2H_5O$—; and a is an integer of 0 to 3.

The drying or heat-treatment of the alkoxysilane compounds may be conducted, for example, at a temperature of usually 40 to 150° C., preferably 60 to 120° C. for usually 10 minutes to 12 hours, preferably 30 minutes to 3 hours.

Specific examples of the alkoxysilane compounds may include methyltriethoxysilane, dimethyldiethoxysilane, phenyltriethyoxysilane, diphenyldiethoxysilane, methyltrimethoxysilane, dimethyldimethoxysilane, phenyltrimethoxysilane, diphenyldimethoxysilane, isobutyltrimethoxysilane, decyltrimethoxysilane or the like. Among these alkoxysilane compounds, in view of the desorption percentage and the adhering effect of carbon black, methyltriethoxysilane, phenyltriethyoxysilane, methyltrimethoxysilane, dimethyldimethoxysilane and isobutyltrimethoxysilane are preferred, and methyltriethoxysilane and methyltrimethoxysilane are more preferred.

As the polysiloxanes (2), there may be used those compounds represented by the formula (II):

(II)

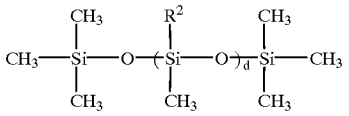

wherein $R^2$ is H— or $CH_3$—, and d is an integer of 15 to 450.

Among these polysiloxanes, in view of the desorption percentage and the adhering effect of the carbon black, polysiloxanes having methyl hydrogen siloxane units are preferred.

As the modified polysiloxanes (2-A), there may be used:

(a) polysiloxanes modified with polyethers represented by the formula (III):

(III)

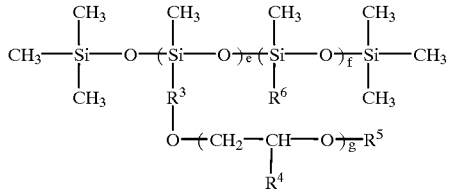

wherein $R^3$ is —(—$CH_2$—)$_h$—; $R^4$ is —(—$CH_2$—)$_i$—$CH_3$; $R^5$ is —OH, —COOH, —CH═$CH_2$, —C($CH_3$)═$CH_2$ or —(—$CH_2$—)$_j$—$CH_3$; $R^6$ is —(—$CH_2$—)$_k$—$CH_3$; g and h are an integer of 1 to 15; i, j and k are an integer of 0 to 15; e is an integer of 1 to 50; and f is an integer of 1 to 300;

(b) polysiloxanes modified with polyesters represented by the formula (IV):

(IV)

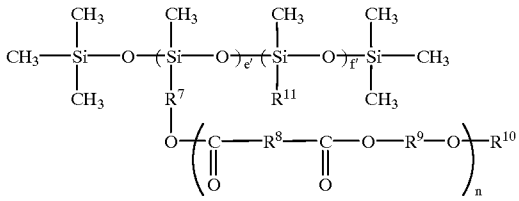

wherein $R^7$, $R^8$ and $R^9$ are —(—$CH_2$—)$_q$— and may be the same or different; $R^{10}$ is —OH, —COOH, —CH═$CH_2$, —C($CH_3$)═$CH_2$ or —(—$CH_2$—)$_r$—$CH_3$; $R^{11}$ is —(—$CH_2$—)$_s$—$CH_3$; n and q are an integer of 1 to 15; r and s are an integer of 0 to 15; e' is an integer of 1 to 50; and f' is an integer of 1 to 300;

(c) polysiloxanes modified with epoxy compounds represented by the formula (V):

(V)

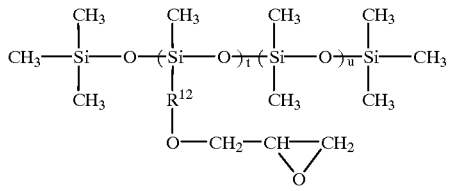

wherein $R^{12}$ is —(—$CH_2$—)$_v$—; v is an integer of 1 to 15; t is an integer of 1 to 50; and u is an integer of 1 to 300; or a mixture thereof.

Among these modified polysiloxanes (2-A), in view of the desorption percentage and the adhering effect of the carbon black, the polysiloxanes modified with the polyethers represented by the formula (III), are preferred.

As the terminal-modified polysiloxanes (2-B), there may be used those represented by the formula (VI):

(VI)

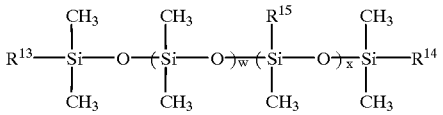

wherein $R^{13}$ and $R^{14}$ are —OH, $R^{16}OH$ or $R^{17}COOH$ and may be the same or different; $R^{15}$ is $—CH_3$ or $—C_6H_5$; $R^{16}$ and $R^{17}$ are $—(—CH_2—)_y—$; y is an integer of 1 to 15; w is an integer of 1 to 200; and x is an integer of 0 to 100.

Among these terminal-modified polysiloxanes, in view of the desorption percentage and the adhering effect of the carbon black, the polysiloxanes whose terminals are modified with carboxylic acid groups are preferred.

The coating amount of the organosilicon compounds is usually 0.02 to 5.0% by weight, preferably 0.03 to 4.0% by weight, more preferably 0.05 to 3.0% by weight (calculated as Si) based on the weight of the magnetic iron oxide particles coated with the organosilicon compounds.

When the coating amount of the organosilicon compounds is less than 0.02% by weight, it may be difficult to adhere the carbon black in a predetermined.

When the coating amount of the organosilicon compounds is more than 5.0% by weight, the carbon black can be adhered in a predetermined. Therefore, it is unnecessary and meaningless to coat the magnetic iron oxide particles with such a large amount of the organosilicon compounds.

The amount of the carbon black coat formed is 1 to 25 parts by weight based on 100 parts by weight of the magnetic iron oxide particles as magnetic core particles.

When the amount of the carbon black coat formed is less than 1 part by weight, the amount of the carbon black may be insufficient, so that it may become difficult to obtain black magnetic composite particles precursor having a sufficient fluidity and blackness.

On the other hand, when the amount of the carbon black coat formed is more than 25 parts by weight, the obtained black magnetic composite particles precursor can show a sufficient fluidity and blackness. However, since the amount of the carbon black is considerably large, the carbon black may tend to be desorbed from the coating layer composed of the organosilicon compound. As a result, the obtained black magnetic composite particles precursor may tend to be deteriorated in dispersibility in a binder resin upon the production of magnetic toner.

The thickness of carbon black coat formed is preferably not more than 0.04 μm, more preferably not more than 0.03 μm, still more preferably not more than 0.02 μm. The lower limit thereof is more preferably 0.0001 μm.

The carbon black may be adhered either over a whole surface of the coating layer composed of the alkoxysilane or polysiloxanes, or on at least a part of the surface of the coating layer so as to expose a part of the coating layer composed of the alkoxysilane or polysiloxanes to the outer surface of each black magnetic composite particle so that a carbon black coat is formed on the surface of the coating layer. Even though a part of the coating layer composed of the alkoxysilane or polysiloxanes is exposed to the outer surface of each black magnetic composite particle precursor, it is possible to suitably adhere the organic blue-based pigment thereonto.

The particle shape and particle size of the black magnetic composite particles precursor used in the present invention are considerably varied depending upon those of the magnetic iron oxide particles as core particles. The black magnetic composite particles precursor have a similar particle shape to that of the magnetic iron oxide particles as core particle, and a slightly larger particle size than that of the magnetic iron oxide particles as core particles.

More specifically, in the case of the isotropic magnetic iron oxide particles, the black magnetic composite particles precursor used in the present invention, have an average particle size of usually 0.055 to 0.95 μm, preferably 0.065 to 0.75 μm, more preferably 0.065 to 0.45 μm and a sphericity of usually not less than 1.0:1 and less than 2.0:1, preferably 1.0:1 to 1.8:1, more preferably 1.0:1 to 1.5:1. In the case of the anisotropic magnetic iron oxide particles, the black magnetic composite particles precursor used in the present invention, have an average particle size of usually 0.055 to 0.95 μm, preferably 0.065 to 0.75 μm, more preferably 0.065 to 0.45 μm and an aspect ratio of usually 2.0:1 to 20.0:1, preferably 2.0:1 to 18.0;1, more preferably 2.0:1 to 15.0:1.

When the average particle size of the magnetite particles is more than 0.95 μm, the obtained black magnetic composite particles precursor may be coarse particle and deteriorated in tinting strength.

On the other hand, when the average particle size is too small, the agglomeration of the black magnetic composite particles precursor may tend to be caused. As a result, it may become difficult to uniformly coat the surface of the black magnetic composite particles precursor with the alkoxysilanes or polysiloxanes, and uniformly adhere the organic blue-based pigment on the surface of the coating layer comprising the alkoxysilanes or polysiloxanes.

When the aspect ratio is more than 20.0:1, the black magnetic composite particles precursor may be entangled with each other in the binder resin, so that it may become difficult to uniformly coat the surface of the black magnetic composite particles precursor with the alkoxysilanes or polysiloxanes, and uniformly adhere the organic blue-based pigment on the surface of the coating layer comprising the alkoxysilanes or polysiloxanes.

The geometrical standard deviation value of the black magnetic composite particles precursor used in the present invention is preferably not more than 2.0, more preferably 1.01 to 1.8, still more preferably 1.01 to 1.6. The lower limit of the geometrical standard deviation value thereof is preferably 1.01. When the geometrical standard deviation value thereof is more than 2.0, it may become difficult to uniformly coat the surface of the black magnetic composite particles precursor with the alkoxysilanes or polysiloxanes, and uniformly adhere the organic blue-based pigment on the surface of the coating layer comprising the alkoxysilanes or polysiloxanes, because of the existence of coarse particles therein. It is industrially difficult to obtain such particles having a geometrical standard deviation of less than 1.01.

The BET specific surface area of the black magnetic composite particles precursor used in the present invention, is usually 0.5 to 95 $m^2/g$, preferably 1.0 to 90 $m^2/g$, more preferably 1.5 to 85 $m^2/g$. When the BET specific surface area thereof is less than 0.5 $m^2/g$, the obtained black magnetic composite particles precursor may be coarse, or the sintering within or between the black magnetic composite particles precursor may be caused, thereby deteriorating the tinting strength. On the other hand, when the BET specific surface area is more than 100 $m^2/g$, the black magnetic composite particles precursor tends to be agglomerated together due to the reduction in particle size, so that it may become difficult to uniformly coat the surface of the black magnetic composite particles precursor with the alkoxysilanes or polysiloxanes, and uniformly adhere the organic blue-based pigment on the surface of the coating layer comprising the alkoxysilanes or polysiloxanes.

As to the fluidity of the black magnetic composite particles precursor used in the present invention, the fluidity index thereof is preferably 44 to 90, more preferably 45 to 90, still more preferably 46 to 90.

As to the hue of the black magnetic composite particles precursor used in the present invention, the lower limit of L* value thereof is usually 2.7, and the upper limit of the L* value is usually 14.5, preferably 14.0; the lower limit of a* value thereof is usually 0.0, and the upper limit of the a* value is usually about 7.0, preferably about 6.0; and the lower limit of b* value thereof is usually −1.0, and the upper limit of the b* value is usually about 6.0, preferably about 5.0. When the L* value exceeds 14.5, the lightness of the particles may be increased, so that it may be difficult to obtain magnetic composite particles having a higher blackness. When the a* value exceeds 7.0, the obtained particles may exhibit a reddish color, so that it may be difficult to obtain magnetic composite particles having a deep black color.

As to the light resistance of the black magnetite composite particles precursor, the ΔE* value is usually more than 4.0, when measured by the below-mentioned method. The upper limit of the ΔE* value thereof is preferably 12.0, more preferably 10.0, when measured by the below-mentioned method.

The desorption percentage of the carbon black from the black magnetite composite particles precursor is preferably not more than 20% by weight, more preferably not more than 10% by weight (calculated as C).

As to the magnetic properties of the black magnetite composite particles precursor as the magnetic core particles, the coercive force value thereof is usually less than 39.790 kA/m (500 Oe), preferably 0.8 to 31.8 kA/m (10 to 400 Oe), more preferably 1.6 to 30.2 kA/m (20 to 380 Oe); the saturation magnetization value thereof in a magnetic field of 795.8 kA/m (10 kOe) is usually 50 to 91 $Am^2/kg$ (50 to 91 emu/g), preferably 60 to 90 $Am^2/kg$ (60 to 90 emu/g); and the residual magnetization value thereof in a magnetic field of 795.8 kA/m (10 kOe) is usually 1 to 35 $Am^2/kg$ (1 to 35 emu/g), preferably 3 to 30 $Am^2/kg$ (3 to 30 emu/g).

In the black magnetic composite particles precursor used in the present invention, at least a part of the surface of the magnetic iron oxide particle may be preliminarily coated with at least one compound selected from the group consisting of hydroxides of aluminum, oxides of aluminum, hydroxides of silicon and oxides of silicon (hereinafter referred to as "hydroxides and/or oxides of aluminum and/or silicon coat"), if necessary. In this case, the obtained black magnetic composite particles precursor having a coating layer composed of hydroxides and/or oxides of aluminum and/or silicon, can more effectively prevent the organic blue-based pigment adhered thereonto from being desorbed therefrom as compared to the case where the black magnetic composite particles precursor wherein the magnetic iron oxide particles are uncoated with hydroxides and/or oxides of aluminum and/or silicon.

The amount of the hydroxides and/or oxides of aluminum and/or silicon coat is preferably 0.01 to 20% by weight (calculated as Al, $SiO_2$ or a sum of Al and $SiO_2$) based on the weight of the magnetic iron oxide particles.

When the amount of the hydroxides and/or oxides of aluminum and/or silicon coat is less than 0.01% by weight, the effect of preventing the desorption of the organic blue-based pigment may not be obtained.

On the other hand, when the amount of the hydroxides and/or oxides of aluminum and/or silicon falls within the above-specified range of 0.01 to 20% by weight, the effect of preventing the desorption of the organic blue-based pigment can be sufficiently exhibited. Therefore, it is unnecessary and meaningless to form the coating layer composed of hydroxides and/or oxides of aluminum and/or silicon in such a large amount exceeding 20% by weight.

The particle size, geometrical standard deviation, BET specific surface area, fluidity, hue (L*, a* and b* values), light resistance (ΔE* value) and magnetic properties of the black magnetic composite particles precursor, wherein the surface of the magnetic iron oxide particle is coated with the hydroxides and/or oxides of aluminum and/or silicon, are substantially the same as those of the black magnetic composite particles precursor wherein the magnetic iron oxide particle is uncoated with the hydroxides and/or oxides of aluminum and/or silicon.

The desorption percentage of the carbon black from the black magnetite composite particles precursor can be reduced by forming the coating layer composed of hydroxides and/or oxides of aluminum and/or silicon thereon, and is preferably not more than 10%, more preferably not more than 8%.

The black magnetic composite particles precursor used in the present invention can be produced by the following method.

Among the isotropic magnetite particles, octahedral magnetite particles can be produced by passing an oxygen-containing gas through a suspension containing ferrous hydroxide colloid having a pH value of not less than 10, which is obtained by reacting an aqueous ferrous salt solution with an aqueous alkali solution having a concentration of not less than one equivalent based on $Fe^{2+}$ in the aqueous ferrous salt solution, thereby precipitating magnetite particles, and then subjecting the obtained magnetite particles to filtering, washing with water and drying (Japanese Patent Publication (KOKOKU) No. 44-668 (1969); hexahedral magnetite particles can be produced by passing an oxygen-containing gas through a suspension containing ferrous hydroxide colloid having a pH value of 6.0 to 7.5, which is obtained by reacting an aqueous ferrous salt solution with an aqueous alkali solution having a concentration of not more than one equivalent based on $Fe^{2+}$ in the aqueous ferrous salt solution to produce magnetite, further passing an oxygen-containing gas through the obtained aqueous ferrous salt reaction solution containing the magnetite and the ferrous hydroxide colloid, at a pH value of 8.0 to 9.5, to precipitate magnetite particles, and then subjecting the precipitated magnetite particles to filtering, washing with water and drying (Japanese Patent Application Laid-Open (KOKAI) No. 3-201509(1991); spherical magnetite particles can be produced by passing an oxygen-containing gas through a suspension containing ferrous hydroxide colloid having a pH value of 6.0 to 7.5, which is obtained by reacting an aqueous ferrous salt solution with an aqueous alkali solution having a concentration of not more than one equivalent based on $Fe^{2+}$ in the aqueous ferrous salt solution to produce magnetite, adding alkali hydroxide in an amount of not less than equivalent based on the remaining $Fe^{2+}$ to adjust the pH value of the suspension to not less than 10, heat-oxidizing the resultant suspension to precipitate magnetite particles, and then subjecting the precipitated magnetite particles to filtering, washing with water and drying (Japanese Patent Publication (KOKOKU) No. 62-51208 (1987).

The isotropic maghemite particles can be obtained by heating the above-mentioned isotropic magnetite particles in air at a temperature of 300 to 600° C.

The anisotropic magnetite particles can be produced by passing an oxygen-containing gas through a suspension containing either ferrous hydroxide colloid, iron carbonate, or an iron-containing precipitate obtained by reacting an aqueous ferrous salt solution with alkali hydroxide and/or alkali carbonate, while appropriately controlling the pH value and temperature of the suspension, to produce acicular, spindle-shaped or rice ball-shaped goethite particles, subjecting the obtained goethite particles to filtering, washing with water and drying, and then reducing the goethite particles in a heat-reducing gas at 300 to 800° C.

The anisotropic maghemite particles can be obtained by heat-oxidizing the above-mentioned anisotropic magnetite particles in an oxygen-containing gas at a temperature of 300 to 600° C.

The coating of the magnetic iron oxide particles with the alkoxysilane compounds, the polysiloxanes, the modified polysiloxanes or the terminal-modified polysiloxanes, may be conducted (i) by mechanically mixing and stirring the magnetic iron oxide particles together with the alkoxysilane compounds, the polysiloxanes, the modified polysiloxanes or the terminal-modified polysiloxanes; or (ii) by mechanically mixing and stirring both the components together while spraying the alkoxysilane compounds, the polysiloxanes, the modified polysiloxanes or the terminal-modified polysiloxanes onto the magnetic iron oxide particles. In these cases, substantially whole amount of the alkoxysilane compounds, the polysiloxanes, the modified polysiloxanes or the terminal-modified polysiloxanes added can be applied onto the surfaces of the magnetic iron oxide particles.

In order to uniformly coat the surfaces of the magnetic iron oxide particles with the alkoxysilane compounds, the polysiloxanes, the modified polysiloxanes or the terminal-modified polysiloxanes, it is preferred that the magnetic iron oxide particles are preliminarily diaggregated by using a pulverizer.

As apparatus (a) for mixing and stirring the magnetic iron oxide particles with the alkoxysilane compounds, the polysiloxanes, the modified polysiloxanes or the terminal-modified polysiloxanes to form the coating layer thereof, and (b) for mixing and stirring carbon black fine particles with the particles whose surfaces are coated with the alkoxysilane compounds, the polysiloxanes, the modified polysiloxanes or the terminal-modified polysiloxanes to form the carbon black coat, there may be preferably used those apparatus capable of applying a shear force to the particles, more preferably those apparatuses capable of conducting the application of shear force, spatulate-force and compressed-force at the same time. In addition, by conducting the above mixing or stirring treatment (a) of the magnetic core particles together with the alkoxysilane compounds, the polysiloxanes, the modified polysiloxanes or the terminal-modified polysiloxanes, at least a part of the alkoxysilane compounds coated on the magnetic iron oxide particles may be changed to the organosilane compounds.

As such apparatuses, there may be exemplified wheel-type kneaders, ball-type kneaders, blade-type kneaders, roll-type kneaders or the like. Among them, wheel-type kneaders are preferred.

Specific examples of the wheel-type kneaders may include an edge runner (equal to a mix muller, a Simpson mill or a sand mill), a multi-mull, a Stotz mill, a wet pan mill, a Conner mill, a ring muller, or the like. Among them, an edge runner, a multi-mull, a Stotz mill, a wet pan mill and a ring muller are preferred, and an edge runner is more preferred.

Specific examples of the ball-type kneaders may include a vibrating mill or the like. Specific examples of the blade-type kneaders may include a Henschel mixer, a planetary mixer, a Nawter mixer or the like. Specific examples of the roll-type kneaders may include an extruder or the like.

In order to coat the surfaces of the magnetic iron oxide particles with the alkoxysilane compounds, the polysiloxanes, the modified polysiloxanes or the terminal-modified polysiloxanes as uniformly as possible, the conditions of the above mixing or stirring treatment may be appropriately controlled such that the linear load is usually 19.6 to 1960 N/cm (2 to 200 Kg/cm), preferably 98 to 1470 N/cm (10 to 150 Kg/cm), more preferably 147 to 980 N/cm (15 to 100 Kg/cm); and the treating time is usually 5 to 120 minutes, preferably 10 to 90 minutes. It is preferred to appropriately adjust the stirring speed in the range of usually 2 to 2,000 rpm, preferably 5 to 1,000 rpm, more preferably 10 to 800 rpm.

The amount of the alkoxysilane compounds, the polysiloxanes, the modified polysiloxanes or the terminal-modified polysiloxanes added, is preferably 0.15 to 45 parts by weight based on 100 parts by weight of the magnetic iron oxide particles. When the amount of the alkoxysilane compounds, the polysiloxanes, the modified polysiloxanes or the terminal-modified polysiloxanes added is less than 0.15 part by weight, it may become difficult to form the carbon black coat in such an amount enough to improve the blackness and flowability of the obtained black magnetic composite particles precursor.

On the other hand, when the amount of the alkoxysilane compounds, the polysiloxanes, the modified polysiloxanes or the terminal-modified polysiloxanes added is more than 45 parts by weight, a sufficient amount of the carbon black coat can be formed on the surface of the coating, but it is meaningless because the blackness and flowability of the obtained black magnetic composite particles precursor cannot be further improved by using such an excess amount of the alkoxysilane compounds, the polysiloxanes, the modified polysiloxanes or the terminal-modified polysiloxanes added.

Next, the carbon black fine particles are added to the magnetic iron oxide particles coated with the alkoxysilane compounds, the polysiloxanes, the modified polysiloxanes or the terminal-modified polysiloxanes, and the resultant mixture is mixed and stirred to form the carbon black coat on the surfaces of the coating composed of the alkoxysilane compounds, the polysiloxanes, the modified polysiloxanes or the terminal-modified polysiloxanes added. In addition, by conducting the above mixing or stirring treatment (b) of the carbon black fine particles together with the magnetic iron oxide particles coated with the alkoxysilane compounds, the polysiloxanes or the modified polysiloxanes, the terminal-modified polysiloxanes, at least a part of the alkoxysilane compounds coated on the magnetic iron oxide particles may be changed to the organosilane compounds.

In the case where the alkoxysilane compounds are used as the coating compound, after the carbon black coat is formed on the surface of the coating layer, the resultant composite particles may be dried or heat-treated, for example, at a temperature of usually 40 to 150° C., preferably 60 to 120° C. for usually 10 minutes to 12 hours, preferably 30 minutes to 3 hours, thereby forming a coating layer composed of the organosilane compounds (1).

It is preferred that the carbon black fine particles are added little by little and slowly, especially about 5 to 60 minutes.

In order to form carbon black onto the coating layer composed of the alkoxysilane compounds, the polysiloxanes, the modified polysiloxanes or the terminal-modified polysiloxanes as uniformly as possible, the conditions of the above mixing or stirring treatment can be appropriately controlled such that the linear load is usually 19.6 to 1960 N/cm (2 to 200 Kg/cm), preferably 98 to 1470 N/cm (10 to 150 Kg/cm), more preferably 147 to 980 N/cm (15 to 100 Kg/cm); and the treating time is usually 5 to 120 minutes, preferably 10 to 90 minutes. It is preferred to appropriately adjust the stirring speed in the range of usually 2 to 2,000 rpm, preferably 5 to 1,000 rpm, more preferably 10 to 800 rpm.

The amount of the carbon black fine particles added, is preferably 1 to 25 parts by weight based on 100 parts by weight of the magnetic iron oxide particles. When the amount of the carbon black fine particles added is less than 1 part by weight, it may become difficult to form the carbon black coat in such an amount enough to improve the blackness and flowability of the obtained black magnetic composite particles precursor. On the other hand, when the amount of the carbon black fine particles added is more than 25 parts by weight, a sufficient blackness and flowability of the resultant black magnetic composite particles precursor can be obtained, but the carbon black tend to be desorbed from the surface of the coating layer because of too large amount of the carbon black adhered, so that it may become difficult to uniformly coat the surface of the black magnetic composite particles precursor with the alkoxysilanes or polysiloxanes, and uniformly adhere the organic blue-based pigment on the surface of the coating layer comprising the alkoxysilanes or polysiloxanes.

At least a part of the surface of the magnetic iron oxide particles may be coated with at least one compound selected from the group consisting of hydroxides of aluminum, oxides of aluminum, hydroxides of silicon and oxides of silicon, if required.

The coat of the hydroxides and/or oxides of aluminum and/or silicon may be conducted by adding an aluminum compound, a silicon compound or both the compounds to a water suspension in which the magnetic iron oxide particles are dispersed, followed by mixing and stirring, and further adjusting the pH value of the suspension, if required, thereby coating the surfaces of the magnetic iron oxide particles with at least one compound selected from the group consisting of hydroxides of aluminum, oxides of aluminum, hydroxides of silicon and oxides of silicon. The thus obtained magnetic iron oxide particles coated with the hydroxides and/or oxides of aluminum and/or silicon are then filtered out, washed with water, dried and pulverized. Further, the magnetic iron oxide particles coated with the hydroxides and/or oxides of aluminum and/or silicon may be subjected to post-treatments such as deaeration treatment and compaction treatment, if required.

As the aluminum compounds, there may be exemplified aluminum salts such as aluminum acetate, aluminum sulfate, aluminum chloride or aluminum nitrate, alkali aluminates such as sodium aluminate or the like.

The amount of the aluminum compound added is 0.01 to 50% by weight (calculated as Al) based on the weight of the magnetic iron oxide particles.

As the silicon compounds, there may be exemplified water glass #3, sodium orthosilicate, sodium metasilicate or the like.

The amount of the silicon compound added is 0.01 to 50% by weight (calculated as $SiO_2$) based on the weight of the magnetic iron oxide particles.

In the case where both the aluminum and silicon compounds are used in combination for the coating, the total amount of the aluminum and silicon compounds added is preferably 0.01 to 50% by weight (calculated as a sum of Al and $SiO_2$) based on the weight of the magnetic iron oxide particles.

Next, the magnetic composite particles according to the present invention are explained.

In the case where isotropic particles are used as magnetic core particles of the magnetic composite particles, the average particle size of the magnetic composite particles is usually 0.06 to 1.0 $\mu$m; and the sphericity thereof is usually not less than 1.0:1 and less than 2.0:1. In the case where anisotropic particles are used as magnetic core particles of the magnetic composite particles, the average major axial diameter of the magnetic composite particles is usually 0.06 to 1.0 $\mu$m; the aspect ratio thereof is usually 2.0:1 to 20.0:1; the geometrical standard deviation value of particle sizes thereof is usually 1.01 to 2.0; the BET specific surface area value thereof is usually 1.0 to 100 $m^2/g$; the fluidity index thereof is usually 44 to 90; the L* value thereof is usually 2.0 to 13.5; the a* value thereof is usually −2.0 to 0.0; the b* value thereof is usually −3.0 to 5.5; the light resistance ($\Delta E^*$ value) thereof is usually not more than 5.0; the desorption percentage of the organic blue-based pigment therefrom is usually not more than 15%; the volume resistivity value thereof is usually not less than $7.0\times10^4$ $\Omega\cdot$cm; the coercive force value thereof is usually less than 39.790 kA/m (500 Oe); the saturation magnetization value thereof in a magnetic field of 795.8 kA/m (10 kOe) is usually 50 to 91 $Am^2/kg$ (50 to 91 emu/g); and the residual magnetization value thereof in a magnetic field of 795.8 kA/m (10 kOe) is usually 1 to 35 $Am^2/kg$ (1 to 35 emu/g).

The particle shape and particle size of the magnetic composite particles largely varies depending upon those of the magnetic core particles such as the magnetite particles (A) and the black magnetic composite particles precursor (B). The particle configuration or structure of the magnetic composite particles is usually similar to that of the magnetic core particles.

More specifically, in the case where the magnetite particles (A) having an isotropic shape are used as magnetic core particles of the magnetic composite particles, the average particle size of the magnetic composite particles is usually 0.06 to 1.0 $\mu$m, preferably 0.07 to 0.8 $\mu$m, more preferably 0.07 to 0.5 $\mu$m; and the sphericity thereof is usually not less than 1.0:1 and less than 2.0:1, more preferably 1.0:1 to 1.8:1. In the case where the magnetite particles (A) having an anisotropic shape are used as magnetic core particles of the magnetic composite particles, the average major axial diameter of the magnetic composite particles is usually 0.06 to 1.0 $\mu$m, preferably 0.07 to 0.8 $\mu$m, more preferably 0.07 to 0.5 $\mu$m; and the aspect ratio thereof is usually 2.0:1 to 20.0:1, preferably 2.0:1 to 18.0:1, more preferably 2.0:1 to 15.0:1.

When the average particle size of the magnetic composite particles is more than 1.0 $\mu$m, the obtained particles may be coarse particles and may be deteriorated in tinting strength. On the other hand, when the average particle size is less than 0.1 $\mu$m, the particle size thereof becomes smaller, so that agglomeration of the particles may tend to be caused, resulting in poor dispersibility in binder resin upon the production of magnetic toner.

In the case where the upper limit of the aspect ratio of the magnetic composite particles exceeds 20.0:1, the obtained particles may tend to be entangled with each other in binder resin upon the production of magnetic toner, resulting in poor dispersibility in the binder resin.

In the case where the magnetite particles (A) are used as magnetic core particles of the magnetic composite particles, the geometrical standard deviation value of particle sizes (major axial diameters in the case of anisotropic particles) of the magnetic composite particles is preferably not more than 2.0, and the lower limit of the geometrical standard deviation value is preferably 1.01, more preferably 1.01 to 1.8, still more preferably 1.01 to 1.6. When the geometrical standard deviation value of the magnetic composite particles is more than 2.0, coarse particles may be contained therein, so that the magnetic composite particles may tend to be deteriorated in tinting strength. It is industrially difficult to obtain particles having a geometrical standard deviation value of less than 1.01.

In the case where the magnetite particles (A) are used as magnetic core particles of the magnetic composite particles, the BET specific surface area value of the magnetic composite particles is usually 1.0 to 100 $m^2/g$, preferably 1.5 to 95 $m^2/g$, more preferably 2.0 to 90 $m^2/g$. When the BET specific surface area value is less than 1.0 $m^2/g$, the magnetic composite particles may become coarse particles, or the sintering within or between the particles may be caused, so that the obtained particles tend to be deteriorated in tinting strength. When the BET specific surface area value is more than 100 $m^2/g$, the particle size thereof becomes smaller, so that agglomeration of the particles may tend to be caused, resulting in poor dispersibility in binder resin upon the production of magnetic toner.

In the case where the magnetite particles (A) are used as magnetic core particles of the magnetic composite particles, as to the fluidity of the magnetic composite particles, the fluidity index thereof is preferably 44 to 90, more preferably 45 to 90, still more preferably 46 to 90. When the fluidity index of the magnetic composite particles is less than 44, the fluidity of the magnetic composite particles may tend to become insufficient, thereby failing to improve the fluidity of the finally obtained magnetic toner. Further, in the production process of the magnetic toner, there may tend to be caused defects such as clogging of hopper, etc., thereby deteriorating the handling property or workability.

In the case where the magnetite particles (A) are used as magnetic core particles of the magnetic composite particles, as to the hue of the magnetic composite particles, the lower limit of L* value thereof is usually 3.0, and the upper limit of the L* value is usually 13.5, preferably 11.0, more preferably 10.0; the lower limit of a* value thereof is usually −2.0, and the upper limit of the a* value is usually 0.0, preferably −0.1, more preferably −0.2; and the lower limit of b* value thereof is usually −3.0, and the upper limit of the b* value is usually 5.5, preferably 5.0. When the L* value exceeds 13.5, the lightness of the particles may be increased, so that it may be difficult to say that the blackness of the magnetic composite particles is excellent. When the a* value exceeds 0.0, the obtained particles may exhibit a reddish color, so that it may be difficult to obtain magnetic composite particles having a deep black color.

In the case where the magnetite particles (A) are used as magnetic core particles of the magnetic composite particles, as to the light resistance of the magnetic composite particles, the ΔE* value thereof is usually not more than 5.0, preferably not more than 4.0, when measured by the below-mentioned method.

In the case where the magnetite particles (A) are used as magnetic core particles of the magnetic composite particles, the desorption percentage of the organic blue-based pigment from the magnetic composite particles is preferably not more than 15%, more preferably not more than 12%. When the desorption percentage of the organic blue-based pigment is more than 15%, uniform dispersion of the obtained magnetic composite particles may tend to be inhibited by the desorbed organic blue-based pigment, and further it may become difficult to obtain magnetic composite particles having a uniform hue, because the hue of the magnetic core particles is exposed to the outer surface of each black magnetic composite particle.

In the case where the magnetite particles (A) are used as magnetic core particles of the magnetic composite particles, the volume resistivity value of the magnetic composite particles is usually not less than $7.0\times10^4$ Ω·cm, preferably $1.0\times10^5$ to $1.0\times10^7$ Ω·cm, more preferably $3.0\times10^5$ to $1.0\times10^7$ Ω·cm. When the volume resistivity value is less than $7.0\times10^4$ Ω·cm, the obtained black magnetic toner may be also deteriorated in volume resistivity.

In the case where the magnetite particles (A) are used as magnetic core particles of the magnetic composite particles, the magnetic properties of the magnetic composite particles may be controlled by appropriately selecting the particle size and particle shape of the magnetite particles (A). Similarly to ordinary magnetic particles used for magnetic toner, the coercive force value of the magnetic composite particles is usually less than 39.790 kA/m (500 Oe), preferably 0.8 to 31.8 kA/m (10 to 400 Oe), more preferably 1.6 to 30.2 kA/m (20 to 380 Oe); the saturation magnetization value thereof in a magnetic field of 795.8 kA/m (10 kOe) is usually 50 to 91 $Am^2/kg$ (50 to 91 emu/g), preferably 60 to 90 $Am^2/kg$ (60 to 90 emu/g); and the residual magnetization value thereof in a magnetic field of 795.8 kA/m (10 kOe) is usually 1 to 35 $Am^2/kg$ (1 to 35 emu/g), preferably 3 to 30 $Am^2/kg$ (3 to 30 emu/g).

In particular, the properties of the magnetic composite particles produced using the black magnetic composite particles precursor (B) as magnetic core particles, are described below.

In the case where the black magnetic composite particles precursor (B) having isotropic particles are used as magnetic core particles of the magnetic composite particles, the average particle size of the magnetic composite particles is usually 0.06 to 1.0 μm, preferably 0.07 to 0.8 μm, more preferably 0.07 to 0.5 μm; and the sphericity thereof is usually not less than 1.0:1 and less than 2.0:1, preferably 1.0:1 to 1.8:1. In the case where the black magnetic composite particles precursor (B) having anisotropic particles are used as magnetic core particles of the magnetic composite particles, the average major axial diameter of the magnetic composite particles is usually 0.06 to 1.0 μm, preferably 0.07 to 0.8 μm, more preferably 0.07 to 0.5 μm; the aspect ratio thereof is usually 2.0:1 to 20.0:1, preferably 2.0:1 to 18.0:1, more preferably 2.0:1 to 15.0:1.

In the case where the black magnetic composite particles precursor (B) is used as magnetic core particles of the magnetic composite particles, the geometrical standard deviation value of particle sizes (major axial diameters in the case of anisotropic particles) of the magnetic composite particles is preferably not more than 2.0, and the lower limit of the geometrical standard deviation value is preferably 1.01, more preferably 1.01 to 1.8, still more preferably 1.01 to 1.6.

In the case where the black magnetic composite particles precursor (B) is used as magnetic core particles of the magnetic composite particles, the BET specific surface area value of the magnetic composite particles is usually 1.0 to 100 $m^2/g$, preferably 1.5 to 95 $m^2/g$, more preferably 2.0 to 90 $m^2/g$.

In the case where the black magnetic composite particles precursor (B) is used as magnetic core particles of the magnetic composite particles, as to the fluidity of the magnetic composite particles, the fluidity index thereof is preferably 44 to 90, more preferably 45 to 90, still more preferably 46 to 90.

In the case where the black magnetic composite particles precursor (B) is used as magnetic core particles of the magnetic composite particles, as to the hue of the magnetic composite particles, the lower limit of L* value thereof is usually 2.0, and the upper limit of the L* value is usually 11.0, preferably 10.0, more preferably 8.5; the lower limit of a* value thereof is usually −2.0, and the upper limit of the a* value is usually 0.0, preferably −0.1, more preferably −0.2; and the lower limit of b* value thereof is usually −3.0, and the upper limit of the b* value is usually 5.5, preferably 5.0.

In the case where the black magnetic composite particles precursor (B) is used as magnetic core particles of the magnetic composite particles, as to the light resistance of the magnetic composite particles, the ΔE* value thereof is usually not more than 4.0, preferably not more than 3.0, when measured by the below-mentioned method.

In the case where the black magnetic composite particles precursor (B) is used as magnetic core particles of the magnetic composite particles, the desorption percentage of the organic blue-based pigment from the magnetite composite particles is preferably not more than 15%, more preferably not more than 12%.

In the case where the black magnetic composite particles precursor (B) is used as magnetic core particles of the magnetic composite particles, the volume resistivity value of the magnetic composite particles is usually not less than $7.0\times10^4$ Ω·cm, preferably $1.0\times10^5$ to $1.0\times10^7$ Ω·cm.

In the case where the black magnetic composite particles precursor (B) is used as magnetic core particles of the magnetic composite particles, the magnetic properties of the magnetic composite particles may be controlled by appropriately selecting the particle size and particle shape of the magnetic iron oxide particles. Similarly to ordinary magnetic particles used for magnetic toner, the coercive force value of the magnetic composite particles is usually less than 39.790 kA/m (500 Oe), preferably 0.8 to 31.8 kA/m (10 to 400 Oe), more preferably 1.6 to 30.2 kA/m (20 to 380 Oe); the saturation magnetization value thereof in a magnetic field of 795.8 kA/m (10 kOe) is usually 50 to 91 $Am^2/kg$ (50 to 91 emu/g), preferably 60 to 90 $Am^2/kg$ (60 to 90 emu/g); and the residual magnetization value thereof in a magnetic field of 795.8 kA/m (10 kOe) is usually 1 to 35 $Am^2/kg$ (1 to 35 emu/g), preferably 3 to 30 $Am^2/kg$ (3 to 30 emu/g).

The coating formed on the surface of the magnetic core particle such as (A) magnetite particles or (B) black magnetic composite particles precursor, comprises at least one organosilicon compound selected from the group consisting of (1) organosilane compounds obtainable from alkoxysilane compounds; and (2) polysiloxanes and modified polysiloxanes selected from the group consisting of (2-A) polysiloxanes modified with at least one compound selected from the group consisting of polyethers, polyesters and epoxy compounds (hereinafter referred to merely as "modified polysiloxanes"), and (2-B) polysiloxanes whose molecular terminal is modified with at least one group selected from the group consisting of carboxylic acid groups, alcohol groups and a hydroxyl group.

The organosilane compounds (1) may be produced by drying or heat-treating alkoxysilane compounds represented by the formula (I):

$$R^1_aSiX_{4-a} \quad \text{(I)}$$

wherein $R^1$ is $C_6H_5$—, $(CH_3)_2CHCH_2$— or n-$C_bH_{2b+1}$— (wherein b is an integer of 1 to 18); X is $CH_3O$— or $C_2H_5O$—; and a is an integer of 0 to 3.

The drying or heat-treatment of the alkoxysilane compounds may be conducted, for example, at a temperature of usually 40 to 200° C., preferably 60 to 150° C. for usually 10 minutes to 12 hours, preferably 30 minutes to 3 hours.

Specific examples of the alkoxysilane compounds may include methyltriethoxysilane, dimethyldiethoxysilane, phenyltriethyoxysilane, diphenyldiethoxysilane, methyltrimethoxysilane, dimethyldimethoxysilane, phenyltrimethoxysilane, diphenyldimethoxysilane, isobutyltrimethoxysilane, decyltrimethoxysilane or the like. Among these alkoxysilane compounds, in view of the desorption percentage and the adhering effect of organic blue-based pigments, methyltriethoxysilane, phenyltriethyoxysilane, methyltrimethoxysilane, dimethyldimethoxysilane and isobutyltrimethoxysilane are preferred, and methyltriethoxysilane and methyltrimethoxysilane are more preferred.

As the polysiloxanes (2), there may be used those compounds represented by the formula (II):

(II)

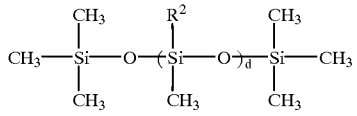

wherein $R^2$ is H— or $CH_3$—, and d is an integer of 15 to 450.

Among these polysiloxanes, in view of the desorption percentage and the adhering effect of the organic blue-based pigments, polysiloxanes having methyl hydrogen siloxane units are preferred.

As the modified polysiloxanes (2-A), there may be used:

(a) polysiloxanes modified with polyethers represented by the formula (III):

(III)

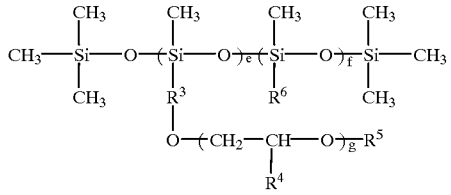

wherein $R^3$ is —(—$CH_2$—)$_h$—; $R^4$ is —(—$CH_2$—)$_i$—$CH_3$; $R^5$ is —OH, —COOH, —CH═$CH_2$, —C($CH_3$)═$CH_2$ or —(—$CH_2$—)$_j$—$CH_3$; $R^6$ is —(—$CH_2$—)$_k$—$CH_3$; g and h are an integer of 1 to 15; i, j and k are an integer of 0 to 15; e is an integer of 1 to 50; and f is an integer of 1 to 300;

(b) polysiloxanes modified with polyesters represented by the formula (IV):

(IV)

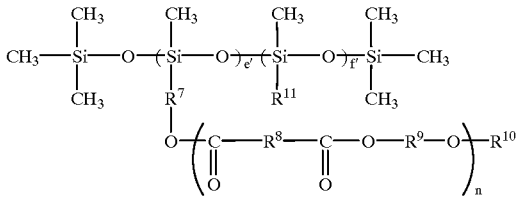

wherein $R^7$, $R^8$ and $R^9$ are —(—$CH_2$—)$_q$— and may be the same or different; $R^{10}$ is —OH, —COOH, —CH═$CH_2$, $—C(CH_3)=CH_2$ or $—(—CH_2—)_r—CH_3$; $R^{11}$ is $—(—CH_2—)_s—CH_3$; n and q are an integer of 1 to 15; r and s are an integer of 0 to 15; e' is an integer of 1 to 50; and f' is an integer of 1 to 300;

(c) polysiloxanes modified with epoxy compounds represented by the formula (V):

(V)

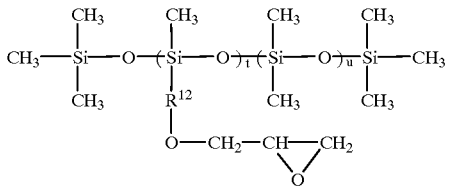

wherein $R^{12}$ is $—(—CH_2—)_v—$; v is an integer of 1 to 15; t is an integer of 1 to 50; and u is an integer of 1 to 300; or a mixture thereof.

Among these modified polysiloxanes (2-A), in view of the desorption percentage and the adhering effect of the organic blue-based pigments, the polysiloxanes modified with the polyethers represented by the formula (III), are preferred.

As the terminal-modified polysiloxanes (2-B), there may be used those represented by the formula (VI):

(VI)

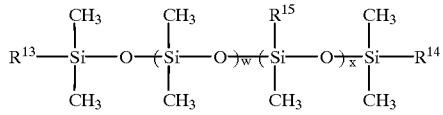

wherein $R^{13}$ and $R^{14}$ are —OH, $R^{16}OH$ or $R^{17}COOH$ and may be the same or different; $R^{15}$ is $—CH_3$ or $—C_6H_5$; $R^{16}$ and $R^{17}$ are $—(—CH_2—)_y—$; y is an integer of 1 to 15; w is an integer of 1 to 200; and x is an integer of 0 to 100.

Among these terminal-modified polysiloxanes, in view of the desorption percentage and the adhering effect of the organic blue-based pigments, the polysiloxanes whose terminals are modified with carboxylic acid groups are preferred.

The coating amount of the organosilicon compounds is usually 0.02 to 5.0% by weight, preferably 0.03 to 4.0% by weight, more preferably 0.05 to 3.0% by weight (calculated as Si) based on the weight of the magnetic core particles coated with the organosilicon compounds.

When the coating amount of the organosilicon compounds is less than 0.02% by weight, it may be difficult to adhere the organic blue-based pigments in a predetermined.

When the coating amount of the organosilicon compounds is more than 5.0% by weight, the organic blue-based pigments can be adhered in a predetermined. Therefore, it is unnecessary and meaningless to coat the magnetic core particles with such a large amount of the organosilicon compounds.

As the organic blue-based pigments used in the present invention, there may be used phthalocyanine-based pigments such as metal-free phthalocyanine blue, phthalocyanine blue (copper phthalocyanine) and fast sky blue (sulfonated copper phthalocyanine), and alkali blue pigments, or the like. In the consideration of the blackness of the obtained magnetic composite particles, among these pigments, it is preferred to use of phthalocyanine-based pigments, more preferably phthalocyanine blue.

In particular, in the consideration of light resistance, the use of low-chlorinated copper phthalocyanine, NC-type (non-crystallization-type) copper phthalocyanine or NC-type low-chlorinated copper phthalocyanine is preferred.

The amount of the organic blue-based pigment adhered is usually 1 to 50 parts by weight, preferably 5 to 30 parts by weight based on 100 parts by weight of the magnetic core particles.

When the amount of the organic blue-based pigment adhered is less than 1 part by weight, it may be difficult to obtain magnetic composite particles having sufficient light resistance and fluidity as well as the aimed hue because of the insufficient amount of the organic blue-based pigment adhered.

When the amount of the organic blue-based pigment adhered is more than 50 parts by weight, although the obtained magnetic composite particles can show sufficient light resistance and fluidity as well as the aimed hue, the organic blue-based pigment may tend to be desorbed therefrom because the amount of the organic blue-based pigment adhered is too large. As a result, the obtained magnetic composite particles may tend to be deteriorated in dispersibility in binder resin upon the production of magnetic toner.

Next, the process for producing the magnetic composite particles according to the present invention, is described.

The magnetic composite particles of the present invention can be produced by mixing magnetite particles (A) or the black magnetic composite particles precursor (B) as magnetic core particles with alkoxysilane compounds or polysiloxanes to coat the surfaces of the magnetic core particles with the alkoxysilane compounds or polysiloxanes; and then mixing the magnetic core particles coated with the alkoxysilane compounds or polysiloxanes, with an organic blue-based pigment.

The coating of the magnetite particles (A) or the black magnetic composite particles precursor (B) as magnetic core particles with the alkoxysilane compounds, the polysiloxanes, the modified polysiloxanes, or the terminal-modified polysiloxanes, may be conducted (i) by mechanically mixing and stirring the magnetite particles (A) or the black magnetic composite particles precursor (B) together with the alkoxysilane compounds, the polysiloxanes, the modified polysiloxanes, or the terminal-modified polysiloxanes; or (ii) by mechanically mixing and stirring both the components together while spraying the alkoxysilane compounds, the polysiloxanes, the modified polysiloxanes, or the terminal-modified polysiloxanes onto the magnetic core particles. In these cases, substantially whole amount of the alkoxysilane compounds, the polysiloxanes, the modified polysiloxanes, or the terminal-modified polysiloxanes added can be applied onto the surfaces of the magnetic core particles.

In addition, by conducting the above-mentioned mixing or stirring treatment (i) of the magnetite particles (A) or the black magnetic composite particles precursor (B) as magnetic core particles together with the alkoxysilane compounds, at least a part of the alkoxysilane compounds coated on the magnetic core particles may be changed to the organosilane compounds. In this case, there is also no affection against the formation of the organic blue-based pigment coat thereon.

In order to uniformly coat the surfaces of the magnetite particles (A) or the black magnetic composite particles precursor (B) as magnetic core particles with the alkoxysilane compounds, the polysiloxanes, the modified polysiloxanes, or the terminal-modified polysiloxanes, it is preferred that the magnetite particles (A) or the black magnetic composite particles precursor (B) are preliminarily diaggregated by using a pulverizer.

As apparatus (a) for mixing and stirring treatment (i) of the magnetic core particles with the alkoxysilane compounds, the polysiloxanes, the modified polysiloxanes, or the terminal-modified polysiloxanes to form the coating layer thereof, and as apparatus (b) for mixing and stirring treatment (ii) of the organic blue-based pigment with the magnetic core particles whose surfaces are coated with the alkoxysilane compounds, the polysiloxanes, the modified polysiloxanes, or the terminal-modified polysiloxanes to form the organic blue-based pigment coat, there may be preferably used those apparatus capable of applying a shear force to the particles, more preferably those apparatuses capable of conducting the application of shear force, spaturate force and compressed force at the same time.

As such apparatuses, there may be exemplified wheel-type kneaders, ball-type kneaders, blade-type kneaders, roll-type kneaders or the like. Among them, wheel-type kneaders are preferred.

Specific examples of the wheel-type kneaders may include an edge runner (equal to a mix muller, a Simpson mill or a sand mill), a multi-mull, a Stotz mill, a wet pan mill, a Conner mill, a ring muller, or the like. Among them, an edge runner, a multi-mull, a Stotz mill, a wet pan mill and a ring muller are preferred, and an edge runner is more preferred.

Specific examples of the ball-type kneaders may include a vibrating mill or the like. Specific examples of the blade-type kneaders may include a Henschel mixer, a planetary mixer, a Nawter mixer or the like. Specific examples of the roll-type kneaders may include an extruder or the like.

In order to coat the surfaces of the magnetic core particles with the alkoxysilane compounds, the polysiloxanes, the modified polysiloxanes, or the terminal-modified polysiloxanes as uniformly as possible, the conditions of the above mixing or stirring treatment may be appropriately controlled such that the linear load is usually 19.6 to 1960 N/cm (2 to 200 Kg/cm), preferably 98 to 1470 N/cm (10 to 150 Kg/cm), more preferably 147 to 980 N/cm (15 to 100 Kg/cm); and the treating time is usually 5 to 120 minutes, preferably 10 to 90 minutes. It is preferred to appropriately adjust the stirring speed in the range of usually 2 to 2,000 rpm, preferably 5 to 1,000 rpm, more preferably 10 to 800 rpm.

The amount of the alkoxysilane compounds, the polysiloxanes, the modified polysiloxanes, or the terminal-modified polysiloxanes added, is preferably 0.15 to 45 parts by weight based on 100 parts by weight of the magnetite particles (A) or the black magnetic composite particles precursor (B) as magnetic core particles. When the amount of the alkoxysilane compounds, the polysiloxanes, the modified polysiloxanes or the terminal-modified polysiloxanes added is less than 0.15 part by weight, it may become difficult to adhere the organic blue-based pigment in such an amount enough to obtain the magnetic composite particles according to the present invention. On the other hand, when the amount of the alkoxysilane compounds, the polysiloxanes, the modified polysiloxanes or the terminal-modified polysiloxanes added is more than 45 parts by weight, since a sufficient amount of the organic blue-based pigment can be adhered on the surface of the coating layer, it is meaningless to add more than 45 parts by weight.

Next, the organic blue-based pigment are added to the magnetite particles (A) or the black magnetic composite particles precursor (B) as magnetic core particles, which are coated with the alkoxysilane compounds, the polysiloxanes, the modified polysiloxanes, or the terminal-modified polysiloxanes, and the resultant mixture is mixed and stirred to form the organic blue-based pigment coat on the surfaces of the coating layer composed of the alkoxysilane compounds, the polysiloxanes, the modified polysiloxanes or the terminal-modified polysiloxanes. The drying or heat-treatment may be conducted.

It is preferred that the organic blue-based pigment are added little by little and slowly, especially about 5 to 60 minutes.

In order to form organic blue-based pigment coat onto the coating layer composed of the alkoxysilane compounds, the polysiloxanes, the modified polysiloxanes, or the terminal-modified polysiloxanes as uniformly as possible, the conditions of the above mixing or stirring treatment can be appropriately controlled such that the linear load is usually 19.6 to 1960 N/cm (2 to 200 Kg/cm), preferably 98 to 1470 N/cm (10 to 150 Kg/cm), more preferably 147 to 980 N/cm (15 to 100 Kg/cm); and the treating time is usually 5 to 120 minutes, preferably 10 to 90 minutes. It is preferred to appropriately adjust the stirring speed in the range of usually 2 to 2,000 rpm, preferably 5 to 1,000 rpm, more preferably 10 to 800 rpm.

The preferable amount of the organic blue-based pigment added is 1 to 50 parts by weight based on 100 parts by weight of the magnetite particles (A) or the black magnetic composite particles precursor (B). When the amount of the organic blue-based pigment added is more than 50 parts by weight, although the obtained magnetic composite particles can show sufficient light resistance and fluidity as well as the aimed hue, the organic blue-based pigment may tend to be desorbed therefrom because the amount of the organic blue-based pigment adhered is too large. As a result, the obtained magnetic composite particles may tend to be deteriorated in dispersibility in binder resin upon the production of magnetic toner.

In case of drying the obtained magnetic composite particles, the temperature is usually 40 to 150° C., preferably 60 to 120° C. The treating time of these steps is usually from 10 minutes to 12 hours, preferably from 30 minutes to 3 hours.

When the obtained magnetic composite particles is subjected to the above dry step, the alkoxysilane compounds used as the coating thereof are finally converted into organosilane compounds.

If required, prior to mixing and stirring with the alkoxysilane compounds or polysiloxanes, the magnetic iron oxide particles may be preliminarily coated with at least one compound selected from the group consisting of hydroxides of aluminum, oxides of aluminum, hydroxides of silicon and oxides of silicon to form an intermediate coating layer thereon.

At least a part of the surface of the magnetic iron oxide particles may be coated with at least one compound selected from the group consisting of hydroxides of aluminum, oxides of aluminum, hydroxides of silicon and oxides of silicon (hereinafter referred to merely as "hydroxides and/or oxides of aluminum and/or silicon"), if required, in advance of mixing and stirring with the alkoxysilane compounds, the polysiloxanes, the modified polysiloxanes or the terminal-modified polysiloxanes.

The coating of the hydroxides and/or oxides of aluminum and/or silicon may be conducted by adding an aluminum compound, a silicon compound or both the compounds to a water suspension in which the magnetic iron oxide particles are dispersed, followed by mixing and stirring, and further adjusting the pH value of the suspension, if required, thereby coating the surfaces of the magnetic iron oxide particles with hydroxides and/or oxides of aluminum and/or silicon. The thus obtained magnetic iron oxide particles coated with the hydroxides and/or oxides of aluminum and/or silicon are then filtered out, washed with water, dried and pulverized. Further, the magnetic iron oxide particles coated with the hydroxides and/or oxides of aluminum and/or silicon may be subjected to post-treatments such as deaeration treatment and compaction treatment, if required.

As the aluminum compounds, there may be exemplified aluminum salts such as aluminum acetate, aluminum sulfate, aluminum chloride or aluminum nitrate, alkali aluminates such as sodium aluminate or the like.

The amount of the aluminum compound added is 0.01 to 20% by weight (calculated as Al) based on the weight of the magnetic iron oxide particles. When the amount of the aluminum compound added is less than 0.01% by weight, it may be difficult to sufficiently coat the surfaces of the magnetic iron oxide particles with hydroxides and/or oxides of aluminum, thereby failing to improve the effective reduction of the organic blue-based pigment desorption percentage. On the other hand, when the amount of the aluminum compound added is more than 20% by weight, the coating effect is saturated and, therefore, it is meaningless to add such an excess amount of the aluminum compound.

As the silicon compounds, there may be exemplified #3 water glass, sodium orthosilicate, sodium metasilicate or the like.

The amount of the silicon compound added is 0.01 to 20% by weight (calculated as $SiO_2$) based on the weight of the magnetic iron oxide particles. When the amount of the silicon compound added is less than 0.01% by weight, it may be difficult to sufficiently coat the surfaces of the magnetic iron oxide particles with hydroxides and/or oxides of silicon, thereby failing to improve the effective reduction of the organic blue-based pigment desorption percentage. On the other hand, when the amount of the silicon compound added is more than 20% by weight, the coating effect is saturated and, therefore, it is meaningless to add such an excess amount of the silicon compound.

In the case where both the aluminum and silicon compounds are used in combination for the coating, the total amount of the aluminum and silicon compounds added is preferably 0.01 to 20% by weight (calculated as a sum of Al and $SiO_2$) based on the weight of the magnetic iron oxide particles.

Next, the black magnetic toner according to the present invention is described.

The black magnetic toner according to the present invention comprises the magnetic composite particles and a binder resin. The black magnetic toner may further contain a mold release agent, a colorant, a charge-controlling agent and other additives, if necessary.

The black magnetic toner according to the present invention has an average particle size of usually 3 to 15 $\mu$m, preferably 5 to 12 $\mu$m.

The amount of the binder resin used in the black magnetic toner is usually 50 to 900 parts by weight, preferably 50 to 400 parts by weight based on 100 parts by weight of the magnetic composite particles.

As the binder resins, there may be used vinyl-based polymers, i.e., homopolymers or copolymers of vinyl-based monomers such as styrene, alkyl acrylates and alkyl methacrylates. As the styrene monomers, there may be exemplified styrene and substituted styrenes. As the alkyl acrylate monomers, there may be exemplified acrylic acid, methyl acrylate, ethyl acrylate, butyl acrylate or the like.

It is preferred that the above copolymers contain styrene-based components in an amount of usually 50 to 95% by weight.

In the binder resin used in the present invention, the above-mentioned vinyl-based polymers may be used in combination with polyester-based resins, epoxy-based resins, polyurethane-based resins or the like, if necessary.

The black magnetic toner of the present invention exhibits a flowability index of usually 70 to 100; an L* value of usually 2.0 to 13.5; an a* value of usually −2.0 to 0.0; a b* value of usually −3.0 to 5.5; a light resistance ($\Delta E^*$ value) of usually not more than 5.0; a volume resistivity value of usually not less than $1.0\times10^{13}$ Ω·cm; a coercive force value of usually less than 39.790 kA/m (500 Oe), preferably 0.8 to 31.8 kA/m (10 to 400 Oe); a saturation magnetization value of usually 10 to 85 $Am^2/kg$ (10 to 85 emu/g) and a residual magnetization value of usually 1 to 20 $Am^2/kg$ (1 to 20 emu/g) when measured in a magnetic field of 795.8 kA/m (10 kOe); and a saturation magnetization value of usually 7.5 to 65 $Am^2/kg$ (7.5 to 65 emu/g) and a residual magnetization value of usually 0.5 to 15 $Am^2/kg$ (0.5 to 15 emu/g) when measured in a magnetic field of 79.6 kA/m (1 kOe).

In the case where the magnetite particles (A) are used as magnetic core particles, the properties of the obtained black magnetic toner are described below.

As to the fluidity of the black magnetic toner according to the present invention, the fluidity index is usually 70 to 100, preferably 71 to 100, more preferably 72 to 100. When the fluidity index is less than 70, the black magnetic toner may not show a sufficient fluidity.

As to the hue of the black magnetic toner, the lower limit of L* value thereof is 3.0, and the upper limit of the L* value is usually 13.5, preferably 11.0, more preferably 10.0; the lower limit of a* value thereof is usually −2.0, and the upper limit of the a* value is usually 0.0, preferably −0.1, more preferably −0.2; and the lower limit of b* value thereof is usually −3.0, and the upper limit of the b* value is usually 5.5, preferably 5.0. When the L* value exceeds 13.5, the lightness of the black magnetic toner is increased, so that it may be difficult to obtain a black magnetic toner having a sufficient blackness. When the a* value exceeds 0.0, the obtained black magnetic toner may exhibit a reddish color, so that it may be difficult to obtain a black magnetic toner having a deep black color.

As to the light resistance of the black magnetic toner, the $\Delta E^*$ value thereof is usually not more than 5.0, preferably not more than 4.0, when measured by the below-mentioned method.

The volume resistivity of the black magnetic toner according to the present invention is usually not less than $1.0\times10^{13}$ Ω·cm, preferably not less than $3.0\times10^{13}$ Ω·cm, more preferably not less than $5.0\times10^{13}$ Ω·cm. When the volume resistivity is less than $1.0\times10^{13}$ Ω·cm, the charge amount of the black magnetic toner may tend to vary depending upon environmental conditions in which the toner is used, resulting in unstable properties of the black magnetic toner. The upper limit of the volume resistivity is $1.0\times10^{17}$ Ω·cm.

As to the magnetic properties of the black magnetic toner according to the present invention, the coercive force thereof is usually less than 39.790 kA/m (500 Oe), preferably 0.8 to 31.8 kA/m (10 to 400 Oe), more preferably 1.6 to 30.2 kA/m (20 to 380 Oe); the saturation magnetization value in a magnetic field of 795.8 kA/m (10 kOe) is usually 10 to 85 $Am^2/kg$ (10 to 85 emu/g), preferably 20 to 80 $Am^2/kg$, (20 to 80 emu/g); the residual magnetization in a magnetic field of 795.8 kA/m (10 kOe) is usually 1 to 20 $Am^2/kg$ (1 to 20 emu/g), preferably 2 to 15 $Am^2/kg$ (2 to 15 emu/g); the saturation magnetization in a magnetic field of 79.6 kA/m (1 kOe) is usually 7.5 to 65 $Am^2/kg$ (7.5 to 65 emu/g), preferably 10 to 60 $Am^2/kg$ (10 to 60 emu/g); and the residual magnetization in a magnetic field of 79.6 kA/m (1 kOe) is usually 0.5 to 15 $Am^2/kg$ (0.5 to 15 emu/g), preferably 1.0 to 13 $Am^2/kg$ (1.0 to 13 emu/g).

In the case where the black magnetic composite particles precursor (B) is used as magnetic core particles, the properties of the obtained black magnetic toner are described below.

The fluidity index is usually 70 to 100, preferably 71 to 100, more preferably 72 to 100.

As to the hue of the black magnetic toner, the lower limit of L* value thereof is usually 2.0, and the upper limit of the L* value is usually 11.0, preferably 10.0, more preferably 8.5; the lower limit of a* value thereof is usually −2.0, and the upper limit of the a* value is usually 0.0, preferably −0.1, more preferably −0.2; and the lower limit of b* value thereof is usually −3.0, and the upper limit of the b* value is usually 5.5, preferably 5.0.

As to the light resistance of the black magnetic toner, the ΔE* value thereof is usually not more than 4.0, preferably not more than 3.0, when measured by the below-mentioned method.

The volume resistivity is usually not less than $1.0\times10^{13}$ Ω·cm, preferably not less than $3.0\times10^{13}$ Ω·cm, more preferably not less than $5.0\times10^{13}$ Ω·cm. The upper limit of the volume resistivity is $1.0\times10^{17}$ Ω·cm.

The coercive force is usually less than 39.790 kA/m (500 Oe), preferably 0.8 to 31.8 kA/m (10 to 400 Oe), more preferably 1.6 to 30.2 kA/m (20 to 380 Oe); the saturation magnetization value in a magnetic field of 795.8 kA/m (10 kOe) is usually 10 to 85 $Am^2/kg$ (10 to 85 emu/g), preferably 20 to 80 $Am^2/kg$, (20 to 80 emu/g); the residual magnetization in a magnetic field of 795.8 kA/m (10 kOe) is usually 1 to 20 $Am^2/kg$ (1 to 20 emu/g), preferably 2 to 15 $Am^2/kg$ (2 to 15 emu/g); the saturation magnetization in a magnetic field of 79.6 kA/m (1 kOe) is usually 7.5 to 65 $Am^2/kg$ (7.5 to 65 emu/g), preferably 10 to 60 $Am^2/kg$ (10 to 60 emu/g); and the residual magnetization in a magnetic field of 79.6 kA/m (1 kOe) is usually 0.5 to 15 $Am^2/kg$ (0.5 to 15 emu/g), preferably 1.0 to 13 $Am^2/kg$ (1.0 to 13 emu/g).

Next, the process for producing the black magnetic toner according to the present invention is described.

The black magnetic toner according to the present invention may be produced by a known method of mixing and kneading a predetermined amount of a binder resin and a predetermined amount of the magnetic composite particles together, and then pulverizing the mixed and kneaded material into particles. More specifically, the magnetic composite particles and the binder resin are intimately mixed together with, if necessary, a mold release agent, a colorant, a charge-controlling agent or other additives by using a mixer. The obtained mixture is then melted and kneaded by a heating kneader so as to render the respective components compatible with each other, thereby dispersing the magnetic composite particles therein. Successively, the molten mixture is cooled and solidified to obtain a resin mixture. The obtained resin mixture is then pulverized and classified, thereby producing a magnetic toner having an aimed particle size.

As the mixers, there may be used a Henschel mixer, a ball mill or the like. As the heating kneaders, there may be used a roll mill, a kneader, a twin-screw extruder or the like. The pulverization of the resin mixture may be conducted by using pulverizers such as a cutter mill, a jet mill or the like. The classification of the pulverized particles may be conducted by known methods such as air classification, etc., as described in Japanese Patent No. 2683142 or the like.

As the other method of producing the black magnetic toner, there may be exemplified a suspension polymerization method or an emulsion polymerization method. In the suspension polymerization method, polymerizable monomers and the magnetic composite particles are intimately mixed together with, if necessary, a colorant, a polymerization initiator, a cross-linking agent, a charge-controlling agent or the other additives and then the obtained mixture is dissolved and dispersed together so as to obtain a monomer composition. The obtained monomer composition is added to a water phase containing a suspension stabilizer while stirring, thereby granulating and polymerizing the composition to form magnetic toner particles having an aimed particle size.

In the emulsion polymerization method, the monomers and the magnetic composite particles are dispersed in water together with, if necessary, a colorant, a polymerization initiator or the like and then the obtained dispersion is polymerized while adding an emulsifier thereto, thereby producing magnetic toner particles having an aimed particle size.

The point of the present invention is that the magnetic composite particles comprising the magnetite particles (A) or black magnetic composite particles precursor (B) as magnetic core particles, onto which the organic blue-based pigment is adhered through organosilane compounds or polysiloxanes, can exhibit not only a deep black color, but also excellent light resistance and fluidity.

The reason why the magnetic composite particles according to the present invention can exhibit a deep black color is considered as follows, though not clearly confirmed. That is, by selecting as a colorant the organic blue-based pigment capable of reducing the reddish color of the magnetite particles (A) or the black magnetic composite particles precursor (B) as magnetic core particles, and selecting as a gluing agent the alkoxysilane or polysiloxanes capable of strongly anchoring the organic blue-based pigment onto the magnetite particles (A) or the black magnetic composite particles precursor (B), the a* value (as an index of red color) of the obtained magnetic composite particles can be reduced to not more than 0.

The reason why the magnetic composite particles according to the present invention can exhibit an excellent light resistance is considered as follows. That is, since the magnetite particles (A) or the black magnetic composite particles precursor (B) inherently showing a poor light resistance are coated with the organosilane compounds or polysiloxanes having an excellent light resistance and further the organic blue-based pigment is adhered onto the coated magnetite particles (A) or the coated black magnetic composite particles precursor (B), the light resistance of the obtained magnetic composite particles can be considerably improved.

The reason why the magnetic composite particles according to the present invention can exhibit an excellent fluidity, is considered as follows. That is, since the organic blue-based pigment is uniformly and densely adhered onto each magnetite particles (A) or black magnetic composite particles precursor (B), a number of irregularities are formed on the surface of the magnetite particles (A) or the black magnetic composite particles precursor (B).

A further point according to the present invention is that the black magnetic toner produced using the magnetic composite particles of the present invention can also exhibit not only excellent light resistance and fluidity but also a deep black color while maintaining a volume resistivity as high as not less than $1\times10^{13}$ Ω·cm.

The reason why the black magnetic toner according to the present invention can exhibit an excellent fluidity is considered as follows. That is, since the magnetic composite particles comprising the magnetite particles (A) or the black magnetic composite particles precursor (B) onto which the organic blue-based pigment is adhered, are exposed to the surface of the black magnetic toner, a number of irregularities are formed on the surface of the black magnetic toner.

The reason why the black magnetic toner according to the present invention can exhibit a deep black color is considered as follows. Namely, this is because the magnetic composite particles having a sufficiently low L* value and an a* value of not more than 0, i.e., capable of exhibiting a deep black color, are blended in the black magnetic toner.

Thus, the magnetic composite particles according to the present invention can exhibit not only a deep black color but also excellent light resistance and fluidity, and, therefore, are suitable as magnetic composite particles for magnetic toner.

Further, the magnetic toner according to the present invention can also exhibit not only a deep black color but also excellent light resistance and fluidity, and, therefore, is suitable as black magnetic toner.

EXAMPLES

The present invention is described in more detail by Examples and Comparative Examples, but the Examples are only illustrative and, therefore, not intended to limit the scope of the present invention.

Various properties were measured by the following methods.

(1) The average particle size, average major axial diameter and average minor axial diameter of the particles were respectively expressed by average values (measured in a predetermined direction) of about 350 particles which were sampled from a micrograph obtained by magnifying an original electron micrograph by four times in each of the longitudinal and transverse directions.

(2) The sphericity of the particles was expressed by a ratio of average major diameter to average minor diameter thereof. The aspect ratio of the particles was expressed by a ratio of average major axial diameter to average minor axial diameter thereof.

(3) The geometrical standard deviation of particle sizes was expressed by values obtained by the following method. That is, the particle sizes were measured from the above magnified electron micrograph. The actual particle sizes and the number of the particles were obtained from the calculation on the basis of the measured values. On a logarithmic normal probability paper, the particle sizes were plotted at regular intervals on the abscissa-axis and the accumulative number (under integration sieve) of particles belonging to each interval of the particle sizes were plotted by percentage on the ordinate-axis by a statistical technique.

The particle sizes corresponding to the number of particles of 50% and 84.13%, respectively, were read from the graph, and the geometrical standard deviation (under integration sieve) was measured from the following formula:

Geometrical standard deviation={particle sizes corresponding to 84.13% under integration sieve}/{particle sizes (geometrical average diameter) corresponding to 50% under integration sieve}

The closer to 1 the geometrical standard deviation value, the more excellent the particle size distribution of the particle sizes.

(4) The specific surface area was expressed by values measured by a BET method.

(5) The amounts of Al and Si which were present within magnetic iron oxide particles or on the surfaces thereof; and the amount of Si contained in the coating layer composed of organosilicon compounds, were measured by a fluorescent X-ray spectroscopy device "3063 M-type" (manufactured by RIGAKU DENKI KOGYO CO., LTD.) according to JIS K0119 "General rule of fluorescent X-ray analysis".

Meanwhile, the amount of Si contained in oxides of silicon, hydroxides of silicon and organosilicon compounds coated on the surfaces of the magnetic iron oxide particles or the black magnetic composite particles precursor, is expressed by the value obtained by subtracting the amount of Si measured prior to the respective treatment steps from that measured after the respective treatment steps.

(6) The amount of carbon black coat formed at the surface of the black magnetic composite particles precursor was measured by "Horiba Metal, Carbon and Sulfur Analyzer EMIA-2200 Model" (manufactured by Horiba Seisakusho Co., Ltd.).

(7) The thickness of carbon black coat formed at the surfaces of the black magnetic composite particles precursor is expressed by the value which was obtained by first measuring an average thickness of carbon black coat formed onto the surfaces of the particles on a photograph (×5,000,000) obtained by magnifying (ten times) a micrograph (×500,000) produced at an accelerating voltage of 200 kV using a transmission-type electron microscope (JEM-2010, manufactured by Japan Electron Co., Ltd.), and then calculating an actual thickness of carbon black coat formed from the measured average thickness.

(8) The amount of the adhered organic blue-based pigments of the magnetic composite particles was obtained by measuring the carbon content thereof using "HORIBA METAL CARBON/SULFUR ANALYZER EMIA-2200 MODEL" (manufactured by Horiba Seisakusho Co., Ltd.).

(9) The fluidity of magnetite particles, black magnetic composite particles precursor, magnetic composite particles and magnetic toner was expressed by a fluidity index which was a sum of indices obtained by converting on the basis of the same reference measured values of an angle of repose, a degree of compaction (%), an angle of spatula and a degree of agglomeration as particle characteristics which were measured by a powder tester (tradename, produced by Hosokawa Micron Co., Ltd.). The closer to 100 the fluidity index, the more excellent the fluidity of the particles.

(10) The hue of each of the magnetite particles, black magnetic composite particles precursor, magnetic composite particles , the organic blue-based pigment and the black magnetic toner, were measured by the following method.

That is, 0.5 g of each sample and 1.5 ml of castor oil were intimately kneaded together by a Hoover's muller to form a paste. 4.5 g of clear lacquer was added to the obtained paste and was intimately mixed to form a paint. The paint was applied on a cast-coated paper by using a 150 $\mu$m (6-mil) applicator to produce a coating film piece (having a film thickness of about 30 $\mu$m). The thus obtained coating film piece was measured by a portable spectrophotometer Cxolor Guide 45/0 (manufactured by BYK-chemie Japan K. K.) to determine L*, a* and b* values thereof.

The L* value represents a lightness, and the smaller the L* value, the more excellent the blackness. The a* value represents a redness, and the smaller the a* value, the less the redness.

(11) The light resistances of the magnetite particles, black magnetic composite particles precursor, magnetic composite particles, organic blue-based pigment and black magnetic toner were measured by the following method.

Ten grams of sample particles, 16 g of an aminoalkyd resin and 6 g of a thinner were charged together with 90 g of 3 mmϕ glass beads into a 140-ml glass bottle, and then mixed and dispersed for 45 minutes by a paint shaker. The resultant mixture was mixed with additional 50 g of the aminoalkyd resin, and further dispersed for 5 minutes by a paint shaker, thereby obtaining a coating composition. The thus obtained coating composition was applied onto a cold-rolled steel plate (0.8 mm×70 mm×150 mm; JIS G-3141) and dried to form a coating film having a thickness of 150 μm. One half of the thus prepared test specimen was covered with a metal foil, and an ultraviolet light was continuously irradiated over the test specimen at an intensity of 100 mW/cm$^2$ for 6 hours using "EYE SUPER UV TESTER SUV-W13" manufactured by Iwasaki Denki Co., Ltd. Then, the hues (L*, a* and b* values) of the metal foil-covered non-irradiated portion and the UV-irradiated portion of the test specimen were respectively measured. The ΔE* value was calculated from differences between the measured hue values of the metal foil-covered non-irradiated portion and the UV-irradiated portion according to the following formula:

$$\Delta E^* = [(\Delta L^*)^2 + (\Delta a^*)^2 + (\Delta b^*)^2]^{1/2}$$

wherein ΔL* represents the difference between L* values of the non-irradiated and UV-irradiated portions; Δa* represents the difference between a* values of the non-irradiated and UV-irradiated portions; and Δb* represents the difference between b* values of the non-irradiated and UV-irradiated portions.

(12) The desorption percentage of carbon black desorbed from the black magnetic composite particles precursor was measured by the following method. The closer to 0% the desorption percentage, the smaller the amount of carbon black desorbed from the surfaces of black magnetic composite particles precursor.

That is, 3 g of the black magnetic composite particles precursor and 40 ml of ethanol were placed in a 50-ml precipitation pipe and then was subjected to ultrasonic dispersion for 20 minutes. Thereafter, the obtained dispersion was allowed to stand for 120 minutes, and the carbon black desorbed were separated from the black magnetic composite particles precursor on the basis of the difference in specific gravity between both the particles. Next, the black magnetic composite particles precursor from which the desorbed carbon black was separated, were mixed again with 40 ml of ethanol, and the obtained mixture was further subjected to ultrasonic dispersion for 20 minutes. Thereafter, the obtained dispersion was allowed to stand for 120 minutes, thereby separating the black magnetic composite particles precursor and the desorbed carbon black desorbed from each other. The thus obtained black magnetic composite particles precursor were dried at 80° C. for one hour, and then the carbon content thereof was measured by the "Horiba Metal, Carbon and Sulfur Analyzer EMIA-2200 Model" (manufactured by Horiba Seisakusho Co., Ltd.). The desorption percentage of the carbon black was calculated according to the following formula:

Desorption percentage of $$\text{carbon black } (\%) = \{(W_a - W_e)/W_a\} \times 100$$

wherein $W_a$ represents an amount of carbon black initially formed on the black magnetic composite particles precursor; and $W_e$ represents an amount of carbon black still adhered on the black magnetic composite particles precursor after desorption test.

(13) The desorption percentage of the organic blue-based pigment desorbed from the magnetic composite particles, is expressed by the value measured by the following method. The closer to 0% the desorption percentage of the organic blue-based pigment, the less the amount of the organic blue-based pigment desorbed from the surface of the magnetic composite particles.

Three grams of the magnetic composite particles and 40 ml of ethanol were placed in a 50-ml precipitation tube, and subjected to ultrasonic dispersion for 20 minutes. The obtained dispersion was allowed to stand for 120 minutes, thereby separating the dispersion into the magnetic composite particles and the organic blue-based pigments desorbed therefrom due to the difference in precipitating speed therebetween. Subsequently, the magnetic composite particles were mixed again with 40 ml of ethanol, and subjected to ultrasonic dispersion for 20 minutes. The obtained dispersion was allowed to stand for 120 minutes, thereby separating the dispersion into the magnetic composite particles and the organic blue-based pigment. The thus separated magnetic composite particles were dried at 80° C. for one hour to measure the amount of the organic blue-based pigment desorbed therefrom. The desorption percentage (%) of the organic blue-based pigment is calculated according to the following formula:

Desorption percentage (%) of organic $$\text{blue-based pigment} = \{(Wab - Web)/Wab\} \times 100$$

wherein Wab represents an amount of the organic blue-based pigment adhered onto the magnetic composite particles ; and Web represents an amount of the organic blue-based pigment adhered onto the magnetic composite particles after desorption test.

(14) The dispersibility in a binder resin of the magnetic composite particles was evaluated by counting the number of undispersed agglomerated particles on a micrograph (×200 times) obtained by photographing a sectional area of the obtained black magnetic toner particle using an optical microscope (BH-2, manufactured by Olympus Kogaku Kogyo Co., Ltd.), and classifying the results into the following five ranks. The 5th rank represents the most excellent dispersing condition.

Rank 1: not less than 50 undispersed agglomerated particles per 0.25 mm$^2$ were recognized;

Rank 2: 10 to 49 undispersed agglomerated particles per 0.25 mm$^2$ were recognized;

Rank 3: 5 to 9 undispersed agglomerated particles per 0.25 mm$^2$ were recognized;

Rank 4: 1 to 4 undispersed agglomerated particles per 0.25 mm$^2$ were recognized;

Rank 5: No undispersed agglomerated particles were recognized.

(15) The average particle size of the black magnetic toner was measured by a laser diffraction-type particle size distribution-measuring apparatus (Model HELOSLA/KA, manufactured by Sympatec Corp.).

(16) The volume resistivity of the magnetite particles, black magnetic composite particles precursor, the magnetic composite particles and the black magnetic toner was measured by the following method.

That is, first, 0.5 g of a sample particles or toner to be measured was weighted, and press-molded at 1.372×10$^7$ Pa (140 Kg/cm$^2$) using a KBr tablet machine (manufactured by Simazu Seisakusho Co., Ltd.), thereby forming a cylindrical test piece.

Next, the thus obtained cylindrical test piece was exposed to an atmosphere maintained at a temperature of 25° C. and a relative humidity of 60% for 12 hours. Thereafter, the cylindrical test piece was set between stainless steel electrodes, and a voltage of 15V was applied between the electrodes using a Wheatstone bridge (TYPE2768, manufactured by Yokogawa-Hokushin Denki Co., Ltd.) to measure a resistance value R (Ω).

The cylindrical test piece was measured with respect to an upper surface area A ($cm^2$) and a thickness $t_0$ (cm) thereof. The measured values were inserted into the following formula, thereby obtaining a volume resistivity X (Ω·cm).

$$X\ (\Omega\cdot\text{cm})=R\times(A/t_0)$$

(17) The magnetic properties of the magnetite particles, black magnetic composite particles precursor and the magnetic composite particles were measured using a vibration sample magnetometer "VSM-3S-15" (manufactured by Toei Kogyo Co., Ltd.) by applying an external magnetic field of 795.8 kA/m (10 kOe) thereto. Whereas, the magnetic properties of the black magnetic toner were measured by applying external magnetic fields of 79.58 kA/m (1 kOe) and 795.8 kA/m (10 kOe) thereto.

EXAMPLE 1

Production of Magnetic Composite Particles 20 kg of spherical magnetite particles (average particle size: 0.27 μm; geometrical standard deviation value: 1.48; sphericity: 1.2; BET specific surface area value: 5.5 $m^2/g$; blackness (L* value): 10.9; a* value: 0.20; b* value: 3.61; light resistance (ΔE* value): 7.1; fluidity index: 37; volume resistivity: $4.8\times10^6$ Ω·cm; coercive force value: 5.0 kA/m (63 Oe); saturation magnetization value in a magnetic field of 795.8 kA/m (10 kOe): 85.0 $Am^2/kg$ (85.0 emu/g); residual magnetization value in a magnetic field of 795.8 kA/m (10 kOe): 8.0 $Am^2/kg$ (8.0 emu/g)), were deagglomerated in 150 liters of pure water using a stirrer, and further passed through a "TK pipeline homomixer" (tradename, manufactured by Tokushu Kika Kogyo Co., Ltd.) three times, thereby obtaining a slurry containing the spherical magnetite particles.

Successively, the obtained slurry containing the spherical magnetite particles was passed through a transverse-type sand grinder (tradename "MIGHTY MILL MHG-1.5L", manufactured by Inoue Seisakusho Co., Ltd.) five times at an axis-rotating speed of 2,000 rpm, thereby obtaining a slurry in which the spherical magnetite particles were dispersed.

The particles in the obtained slurry which remained on a sieve of 325 meshes (mesh size: 44 μm) was 0%. The slurry was filtered and washed with water, thereby obtaining a filter cake containing the spherical magnetite particles. After the obtained filter cake containing the spherical magnetite particles was dried at 120° C., 11.0 kg of the dried particles were then charged into an edge runner "MPUV-2 Model" (tradename, manufactured by Matsumoto Chuzo Tekkosho Co., Ltd.), and mixed and stirred at 294 N/cm (30 Kg/cm) and a stirring speed of 22 rpm for 30 minutes, while introducing a $N_2$ gas at a rate of 2 1/minute, thereby lightly deagglomerating the particles.

110 g of methyltriethoxysilane was mixed and diluted with 200 ml of ethanol to obtain a methyltriethoxysilane solution. The methyltriethoxysilane solution was added to the deagglomerated spherical magnetite particles under the operation of the edge runner. The spherical magnetite particles were continuously mixed and stirred at a linear load of 588 N/cm (60 Kg/cm) and a stirring speed of 22 rpm for 30 minutes to form a coating layer composed of methyltriethoxysilane on the spherical magnetite particles.

Next, 825 g of an organic blue-based pigment A (kind: Copper phthalocyanine blue; particle shape: granular shape; average major axial diameter: 0.06 μm; BET specific surface area: 71.6 $m^2/g$; L* value: 5.2; a* value: 9.7; b* value: −21.8; light resistance (ΔE* value): 24.5), were added to the above mixture for 10 minutes while operating the edge runner. Further, the obtained mixture was mixed and stirred at a linear load of 588 N/cm (60 Kg/cm) and a stirring speed of 22 rpm for 20 minutes to form a coating layer composed of the organic blue-based pigment A on the methyltriethoxysilane coat, thereby obtaining composite particles. The obtained composite particles were heat-treated at 105° C. for 60 minutes by using a drier, thereby obtaining magnetic composite particles.

The obtained magnetic composite particles had an average particle diameter of 0.27 μm, a sphericity of 1.2:1, a geometrical standard deviation value of 1.48, a BET specific surface area value of 6.2 $m^2/g$, a fluidity index of 50, a blackness (L* value) of 7.5, an a* value of −0.43, a b* value of −0.28, a light resistance (ΔE* value) of 3.9, a volume resistivity of $8.8\times10^5$ Ω·cm. The desorption percentage of the organic blue-based pigment A from the magnetic composite particles was 5.7% by weight. The obtained back magnetic composite particles had as magnetic properties, a coercive force value: 4.9 kA/m (62 Oe); a saturation magnetization value in a magnetic field of 795.8 kA/m (10 kOe): 77.1 $Am^2/kg$ (77.1 emu/g); and a residual magnetization value in a magnetic field of 795.8 kA/m (10 kOe): 7.2 $Am^2/kg$ (7.2 emu/g).

The amount of a coating layer composed of organosilane compounds produced from methyltriethoxysilane was 0.15% by weight (calculated as Si). The amount of the coating layer composed of the organic blue-based pigment A was 4.61% by weight (calculated as C) (corresponding to 7.5 parts by weight based on 100 parts by weight of the spherical magnetite particles).

As a result of the observation of electron micrograph, almost no organic blue-based pigment A liberated was recognized, so that it was confirmed that a substantially whole amount of the organic blue-based pigment A added was adhered on the coating layer composed of the organosilane compounds produced from methyltriethoxysilane.

Production of Black Magnetic Toner 450 g of the magnetic composite particles obtained, 550 g of styrene-butyl acrylate-methyl methacrylate copolymer resin (molecular weight=130,000, styrene/butyl acrylate/methyl methacrylate =82.0/16.5/1.5), 55 g of polypropylene wax (molecular weight: 3,000) and 15 g of a charge-controlling agent were charged into a Henschel mixer, and mixed and stirred therein at 60° C. for 15 minutes. The obtained mixed particles were melt-kneaded at 140° C. using a continuous-type twin-screw kneader (T-1), and the obtained kneaded material was cooled, coarsely pulverized and finely pulverized in air. The obtained particles were subjected to classification, thereby producing a black magnetic toner.

The obtained black magnetic toner had an average particle size of 10.0 μm, a dispersibility of 5th rank, a fluidity index of 77, a blackness (L* value) of 8.1, an a* value of −0.14, a b* value of −0.22, a light resistance (ΔE* value) of 3.2, a volume resistivity of $3.8\times10^{14}$ Ω·cm, a coercive force value of 4.9 kA/m (61 Oe), a saturation magnetization value in a magnetic field of 795.8 kA/m (10 kOe) of 33.4 $Am^2/kg$ (33.4 emu/g) a residual magnetization value in a magnetic field of 795.8 kA/m (10 kOe) of 4.2 $Am^2/kg$ (4.2 emu/g), a saturation magnetization value in a magnetic field of 79.6 kA/m (1 kOe) of 25.8 $Am^2/kg$ (25.8 emu/g) a residual magnetization value in a magnetic field of 79.6 kA/m (1 kOe) of 3.4 $Am^2/kg$ (3.4 emu/g).

EXAMPLE 2

Production of Black Magnetic Composite Particles Precursor 20 kg of octahedral magnetite particles (average particle size: 0.27 μm; geometrical standard deviation value: 1.50; BET specific surface area value: 5.2 $m^2/g$; blackness (L* value): 11.6; a* value: 0.20; b* value: 4.07; light resistance (ΔE* value): 7.3; fluidity index: 34; volume resistivity: $5.6\times10^6$ Ω·cm; coercive force value: 8.4 kA/m (105 Oe); saturation magnetization value in a magnetic field of 795.8 kA/m (10 kOe): 86.3 $Am^2/kg$ (86.3 emu/g); residual magnetization value in a magnetic field of 795.8 kA/m (10 kOe): 11.8 $Am^2/kg$ (11.8 emu/g)), were deagglomerated in 150 liters of pure water using a stirrer, and further passed through a "TK pipeline homomixer" (tradename, manufactured by Tokushu Kika Kogyo Co., Ltd.) three times, thereby obtaining a slurry containing the octahedral magnetite particles.

Successively, the obtained slurry containing the octahedral magnetite particles was passed through a transverse-type sand grinder (tradename "MIGHTY MILL MHG-1.5L", manufactured by Inoue Seisakusho Co., Ltd.) five times at an axis-rotating speed of 2,000 rpm, thereby obtaining a slurry in which the octahedral magnetite particles were dispersed.

The particles in the obtained slurry which remained on a sieve of 325 meshes (mesh size: 44 μm) was 0%. The slurry was filtered and washed with water, thereby obtaining a filter cake containing the octahedral magnetite particles. After the obtained filter cake containing the octahedral magnetite particles was dried at 120° C., 11.0 kg of the dried particles were then charged into an edge runner "MPUV-2 Model" (tradename, manufactured by Matsumoto Chuzo Tekkosho Co., Ltd.), and mixed and stirred at 294 N/cm(30 Kg/cm) and a stirring speed of 22 rpm for 30 minutes, while introducing a $N_2$ gas at a rate of 2 l/minute, thereby lightly deagglomerating the particles.

110 g of methyltriethoxysilane was mixed and diluted with 200 ml of ethanol to obtain a methyltriethoxysilane solution. The methyltriethoxysilane solution was added to the deagglomerated octahedral magnetite particles under the operation of the edge runner. The octahedral magnetite particles were continuously mixed and stirred at a linear load of 588 N/cm (60 Kg/cm) and a stirring speed of 22 rpm for 60 minutes to form a coating layer composed of methyltriethoxysilane on the octahedral magnetite particles.

Next, 1100 g of carbon black fine particles (particle shape: granular shape; average particle size: 0.022 μm; geometrical standard deviation value: 1.68; BET specific surface area value: 134 $m^2/g$; and blackness (L* value): 5.0) were added to the octahedral magnetite particles coated with methyltriethoxysilane for 10 minutes while operating the edge runner. Further, the mixed particles were continuously stirred at a linear load of 588 N/cm (60 Kg/cm) and a stirring speed of 22 rpm for 60 minutes to form the carbon black coat on the coating layer composed of methyltriethoxysilane, thereby obtaining magnetic composite particles. The obtained composite particles were heat-treated at 80° C. for 60 minutes by using a drier, thereby obtaining a black magnetic composite particles precursor.

The obtained back magnetic composite particles precursor had an average particle diameter of 0.27 μm, a geometrical standard deviation value of 1.51, a BET specific surface area value of 7.2 $m^2/g$, a fluidity index of 50, a blackness (L* value) of 7.2, an a* value of 1.86, a b* value of 1.28, a light resistance (ΔE* value) of 4.8, a volume resistivity of $8.6\times10^3$ Ω·cm. The desorption percentage of the carbon black from the magnetic composite particles precursor was 7.1% by weight. The obtained back magnetic composite particles precursor had as magnetic properties, a coercive force value: 8.2 kA/m (103 Oe); a saturation magnetization value in a magnetic field of 795.8 kA/m (10 kOe): 80.0 $Am^2/kg$ (80.0 emu/g); and a residual magnetization value in a magnetic field of 795.8 kA/m (10 kOe): 11.0 $Am^2/kg$ (11.0 emu/g).

The coating amount of an organosilane compound produced from methyltriethoxysilane was 0.15% by weight calculated as Si. The amount of the carbon black coat formed on the coating layer composed of the organosilane compound produced from methyltriethoxysilane is 9.05% by weight (calculated as C) based on the weight of the black magnetic composite particles precursor (corresponding to 10 parts by weight based on 100 parts by weight of the octahedral magnetite particles). The thickness of the carbon black coat formed was 0.0024 μm. Since no independent carbon black was observed on the electron micrograph, it was determined that a whole amount of the carbon black used contributed to the formation of the carbon black coat on the coating layer composed of the organosilane compound produced from methyltriethoxysilane.

Production of Magnetic Composite Particles

The thus obtained black magnetic composite particles precursor 11.0 kg were charged into an edge runner "MPUV-2 Model" (tradename, manufactured by Matsumoto Chuzo Tekkosho Co., Ltd.), and mixed and stirred at 294 N/cm (30 Kg/cm) and a stirring speed of 22 rpm for 30 minutes, thereby lightly deagglomerating the particles.

110 g of methyltriethoxysilane was mixed and diluted with 200 ml of ethanol to obtain a methyltriethoxysilane solution. The methyltriethoxysilane solution was added to the deagglomerated black magnetic composite particles precursor under the operation of the edge runner. The black magnetic composite particles precursor were continuously mixed and stirred at a linear load of 588 N/cm (60 Kg/cm) and a stirring speed of 22 rpm for 30 minutes to form a coating layer composed of methyltriethoxysilane on the black magnetic composite particles precursor.

Next, 3300 g of an organic blue-based pigment A (kind: copper phthalocyanine blue; particle shape: granular shape; average major axial diameter: 0.06 μm; BET specific surface area: 71.6 $m^2/g$; L* value: 5.2; a* value: 9.7; b* value: −21.8; light resistance (ΔE* value): 24.5), were added to the above mixture for 10 minutes while operating the edge runner. Further, the obtained mixture was mixed and stirred at a linear load of 588 N/cm (60 Kg/cm) and a stirring speed of 22 rpm for 20 minutes to form a coating layer composed of the organic blue-based pigment A on the methyltriethoxysilane coat, thereby obtaining composite particles. The obtained composite particles were heat-treated at 80° C. for 60 minutes by using a drier, thereby obtaining magnetic composite particles.

The obtained back magnetic composite particles had an average particle diameter of 0.28 μm, a geometrical standard deviation value of 1.51, a BET specific surface area value of 7.7 $m^2/g$, a fluidity index of 57, a blackness (L* value) of 6.1, an a* value of −0.29, a b* value of −0.11, a light resistance (ΔE* value) of 1.9, a volume resistivity of $1.3\times10^5$ Ω·cm. The desorption percentage of the organic blue pigment from the magnetic composite particles was 7.6% by weight. The obtained magnetic composite particles had as magnetic properties, a coercive force value: 7.9 kA/m (99 Oe); a saturation magnetization value in a magnetic field of 795.8 kA/m (10 kOe):70.0 $Am^2/kg$ (70.0 emu/g); and a residual magnetization value in a magnetic field of 795.8 kA/m (10 kOe): 9.8 $Am^2/kg$ (9.8 emu/g).

The amount of a coating layer composed of organosilane compounds produced from methyltriethoxysilane was 0.15% by weight (calculated as Si). The amount of the coating layer composed of the organic blue-based pigment A was 15.32% by weight (calculated as C) (corresponding to 30 parts by weight based on 100 parts by weight of the black magnetic composite particles precursor).

As a result of the observation of electron micrograph, almost no organic blue-based pigment A liberated was recognized, so that it was confirmed that a substantially whole amount of the organic blue-based pigment A added was adhered on the coating layer composed of the organosilane compounds produced from methyltriethoxysilane.

Production of Black Magnetic Toner 450 g of the thus obtained magnetic composite particles, 550 g of styrene-butyl acrylate-methyl methacrylate copolymer resin (molecular weight=130,000, styrene/butyl acrylate/methyl methacrylate =82.0/16.5/1.5), 55 g of polypropylene wax (molecular weight: 3,000) and 15 g of a charge-controlling agent were charged into a Henschel mixer, and mixed and stirred therein at 60° C. for 15 minutes. The obtained mixed particles were melt-kneaded at 140° C. using a continuous-type twin-screw kneader (T-1), and the obtained kneaded material was cooled, coarsely pulverized and finely pulverized in air. The obtained particles were subjected to classification, thereby producing a black magnetic toner.

The obtained black magnetic toner had an average particle size of 10.0 $\mu$m, a dispersibility of 5th rank, a fluidity index of 83, a blackness (L* value) of 6.4, an a* value of −0.27, a b* value of 0.26, a light resistance ($\Delta E^*$ value) of 1.5, a volume resistivity of $7.9\times10^{13}$ Ω·cm, a coercive force value of 7.5 kA/m (94 Oe), a saturation magnetization value in a magnetic field of 795.8 kA/m (10 kOe) of 32.5 $Am^2/kg$ (32.5 emu/g) a residual magnetization value in a magnetic field of 795.8 kA/m (10 kOe) of 4.9 $Am^2/kg$ (4.9 emu/g), a saturation magnetization value in a magnetic field of 79.6 kA/m (1 kOe) of 25.1 $Am^2/kg$ (25.1 emu/g) a residual magnetization value in a magnetic field of 79.6 kA/m (1 kOe) of 3.3 $Am^2/kg$ (3.3 emu/g).

Magnetite Particles 1 to 3

Various magnetite particles were used as magnetic core particles.

Various properties of the thus obtained magnetite particles are shown in Table 1.

Magnetite Particles 4

The same procedure as defined in Example 1 was conducted by using 20 kg of the deagglomerated octahedral magnetite particles (magnetite particles 1) and 150 liters of water, thereby obtaining a slurry containing the octahedral magnetite particles. The pH value of the obtained re-dispersed slurry containing the octahedral magnetite particles was adjusted to 10.5 using an aqueous sodium hydroxide solution, and then the concentration of the solid content in the slurry was adjusted to 98 g/liter by adding water thereto. After 150 liters of the slurry was heated to 60° C., 5,444 ml of a 1.0 mol/liter sodium aluminate solution (corresponding to 1.0% by weight (calculated as Al) based on the weight of the octahedral magnetite particles) was added to the slurry. After allowing the obtained slurry to stand for 30 minutes, the pH value of the obtained slurry was adjusted to 7.5 by adding acetic acid thereto. Successively, 139 g of water glass #3 (equivalent to 0.2% by weight (calculated as $SiO_2$) based on the weight of the octahedral magnetite particles) was added to the slurry. After the slurry was aged for 30 minutes, the pH value of the slurry was adjusted to 7.5 by adding acetic acid. After further allowing the slurry to stand for 30 minutes, the slurry was subjected to filtration, washing with water, drying and pulverization, thereby obtaining the octahedral magnetite particles coated with hydroxides of aluminum and oxides of silicon.

Main production conditions are shown in Table 2, and various properties of the obtained surface-treated octahedral magnetite particles are shown in Table 3.

Magnetite Particles 5 to 6

The same procedure as defined in the production of the magnetite particles 4 above, was conducted except that kind of magnetite particles, and kind and amount of additives used in the surface treatment were varied, thereby obtaining surface-treated magnetite particles.

Main production conditions are shown in Table 2, and various properties of the obtained surface-treated magnetite particles are shown in Table 3.

Meanwhile, as to kind of coating material used in the surface-treatment step, "A" represents hydroxides of aluminum; and "S" represents oxides of silicon.

Organic Blue-Based Pigments A to C

As organic blue-based pigments, there were prepared phthalocyanine blue pigments having properties shown in Table 4.

EXAMPLES 3 to 8 and Comparative Examples 1 to 4

The same procedure as defined in Example 1 was conducted except that kind of magnetite particles, kind and amount of alkoxysilane or polysiloxanes added in the coating step therewith, linear load and time of edge runner treatment in the coating step, kind and amount of organic blue-based pigment adhered in the pigment-adhering step, and linear load and time of edge runner treatment in the pigment-adhering step, were varied, thereby obtaining magnetic composite particles.

Production conditions are shown in Table 5, and various properties of the obtained magnetic composite particles are shown in Table 6.

EXAMPLES 9 to 14 and Comparative Examples 5 to 11

The same procedure as defined in Example 1 was conducted except that kind of magnetic composite particles were varied, thereby obtaining a magnetic toner.

Production conditions are shown in Table 7, and various properties of the obtained magnetic toner are shown in Table 8.

Magnetic Core Particles 1

The same procedure as defined in Example 2 was conducted except that kind of core particles, kind and amount of alkoxysilane added in the coating step therewith, linear load and time of the edge runner treatment in the coating step, amount of adhered carbon black fine particles in the carbon black-adhering step, and linear load and time of the edge runner treatment in the carbon black-adhering step, were varied, thereby obtaining black magnetic composite particles precursor.

Various properties of the obtained obtaining black magnetic composite particles precursor are shown in Table 9.

Example 15

The same procedure as defined in Example 2 was conducted except that kind of magnetic composite particles precursor as magnetic core particles, kind and amount of alkoxysilane or polysiloxanes added in the coating step therewith, linear load and time of edge runner treatment in the coating step, kind and amount of organic blue-based pigment adhered in the pigment-adhering step, and linear load and time of edge runner treatment in the pigment-adhering step, were varied, thereby obtaining magnetic composite particles.

Various properties of the obtained black magnetic composite particles precursor are shown in Table 10.

Various properties of the obtained magnetic composite particles are shown in Table 11.

EXAMPLE 16

The same procedure as defined in Example 2 was conducted except that kind of magnetic composite particles were varied, thereby obtaining a black magnetic toner.

Production conditions are shown in Table 12, and various properties of the obtained black magnetic toner are shown in Table 13.

TABLE 1

| Magnetite particles | Properties of magnetite particles | | |
|---|---|---|---|
| | Particle shape | Average particle size (average major axial diameter) (μm) | Sphericity (aspect ratio) (–) |
| Magnetite particles 1 | Octahedral | 0.27 | — |
| Magnetite particles 2 | Spherical | 0.22 | 1.1:1 |
| Magnetite particles 3 | Acicular | 0.38 | 7.5:1 |

| | Properties of magnetite particles | | |
|---|---|---|---|
| | Geometrical standard deviation value (–) | BET specific surface area value ($m^2/g$) | Volume reisitivity value ($\Omega \cdot cm$) |
| Magnetite particles 1 | 1.50 | 5.2 | $5.6 \times 10^6$ |
| Magnetite particles 2 | 1.41 | 7.2 | $7.1 \times 10^6$ |
| Magnetite particles 3 | 1.56 | 25.8 | $3.8 \times 10^6$ |

| | Properties of magnetite particles Magnetic properties Coercive force value | |
|---|---|---|
| | (kA/m) | (Oe) |
| Magnetite particles 1 | 8.4 | 105 |
| Magnetite particles 2 | 5.2 | 65 |
| Magnetite particles 3 | 28.6 | 360 |

| | Properties of magnetite particles | | |
|---|---|---|---|
| | Magnetic properties | | |
| | Saturation magnetization value (795.8 kA/m; 10 kOe) ($Am^2/kg$) | Residual magnetization value (795.8 kA/m; 10 kOe) ($Am^2/kg$) | Fluidity index (–) |
| Magnetite particles 1 | 86.3 | 11.8 | 34 |
| Magnetite particles 2 | 84.8 | 7.6 | 36 |
| Magnetite particles 3 | 86.2 | 29.6 | 30 |

| | Properties of Magnetite particles | | | |
|---|---|---|---|---|
| | Hue | | | Light resistance |
| | L* value (–) | a* value (–) | b* value (–) | (ΔE* value) (–) |
| Magnetite particles 1 | 11.6 | 0.20 | 4.07 | 7.3 |
| Magnetite particles 2 | 9.9 | 0.53 | 3.16 | 6.7 |
| Magnetite particles 3 | 15.0 | 1.32 | 4.82 | 9.7 |

TABLE 2

| Magnetite particles | Kind of magnetite particles | Surface-treating step Additives | | |
|---|---|---|---|---|
| | | Kind | Calculated as | Amount (wt. %) |
| Magnetite particles 4 | Magnetite particles 1 | Sodium aluminate | Al | 1.0 |
| | | Water glass #3 | $SiO_2$ | 0.2 |
| Magnetite particles 5 | Magnetite particles 2 | Water glass #3 | $SiO_2$ | 0.5 |
| Magnetite particles 6 | Magnetite particles 3 | Aluminum sulfate | Al | 5.0 |

| Magnetite particles | Surface-treating step Coating material | | |
|---|---|---|---|
| | Kind | Calculated as | Amount (wt. %) |
| Magnetite particles 4 | A | Al | 0.98 |
| | S | $SiO_2$ | 0.19 |
| Magnetite particles 5 | S | $SiO_2$ | 0.48 |
| Magnetite particles 6 | A | Al | 4.76 |

TABLE 3

| Magnetite particles | Properties of surface-treated magnetite particles | |
|---|---|---|
| | Average particle size (average major axial diameter) (μm) | Sphericity (aspect ratio) (–) |
| Magnetite particles 4 | 0.27 | — |
| Magnetite particles 5 | 0.22 | 1.1:1 |
| Magnetite particles 6 | 0.38 | 7.5:1 |

| | Geometrical standard deviation value | BET specific surface area | Volume reisitivity value |
|---|---|---|---|

TABLE 3-continued

| Magnetite particles | Properties of surface-treated magnetite particles | | |
|---|---|---|---|
| | (–) | value ($m^2/g$) | ($\Omega \cdot cm$) |
| Magnetite particles 4 | 1.50 | 5.2 | $8.9 \times 10^6$ |
| Magnetite particles 5 | 1.41 | 7.8 | $9.3 \times 10^6$ |
| Magnetite particles 6 | 1.56 | 26.1 | $2.6 \times 10^7$ |

| | Magnetic properties Coercive force value | |
|---|---|---|
| | (kA/m) | (Oe) |
| Magnetite particles 4 | 8.2 | 103 |
| Magnetite particles 5 | 5.2 | 65 |
| Magnetite particles 6 | 28.3 | 356 |

| | Magnetic properties | | |
|---|---|---|---|
| | Saturation magnetization value (795.8 kA/m; 10 kOe) ($Am^2/kg$) | Residual magnetization value (795.8 kA/m; 10 kOe) ($Am^2/kg$) | Fluidity index (–) |
| Magnetite particles 4 | 86.0 | 11.7 | 36 |
| Magnetite particles 5 | 84.7 | 7.5 | 38 |
| Magnetite particles 6 | 84.6 | 29.4 | 33 |

| | Hue | | | Light |
|---|---|---|---|---|
| | L* value (–) | a* value (–) | b* value (–) | resistance (ΔE* value) (–) |
| Magnetite particles 4 | 12.0 | 0.22 | 4.02 | 6.9 |
| Magnetite particles 5 | 10.2 | 0.56 | 3.15 | 6.2 |
| Magnetite particles 6 | 15.3 | 1.38 | 4.85 | 9.1 |

TABLE 4

| Organic blue-based pigment | Properties of organic blue-based pigment | |
|---|---|---|
| | Kind | Particle shape |
| Organic blue-based pigment A | Copper phthalocyanine blue (C. I. Pigment Blue 15:1) | Granular |
| Organic blue-based pigment B | Copper phthalocyanine blue (C. I. Pigment Blue 15:4) | Granular |
| Organic blue-based pigment C | Copper phthalocyanine blue (C. I. Pigment Blue 15:2) | Granular |

| | Average particle size (μm) | BET specific surface area value ($m^2/g$) |
|---|---|---|
| Organic blue-based pigment A | 0.06 | 71.6 |
| Organic blue-based pigment B | 0.08 | 56.3 |
| Organic blue-based pigment C | 0.10 | 45.2 |

| | Hue | | | Light |
|---|---|---|---|---|
| | L* value (–) | a* value (–) | b* value (–) | resistance (ΔE* value) (–) |
| Organic blue-based pigment A | 5.2 | 9.7 | −21.8 | 4.8 |
| Organic blue-based pigment B | 4.6 | 11.6 | −25.1 | 2.6 |
| Organic blue-based pigment C | 3.9 | 12.1 | −27.8 | 3.7 |

TABLE 5

| Examples and Comparative Examples | | Production of magnetic composite particles Coating step with alkoxysilane or polysiloxanes Additives | |
|---|---|---|---|
| | Kind of magnetite particles | Kind | Amount added (part by weight) |
| Example 3 | Magnetite particles 1 | Methyl triethoxysilane | 2.0 |
| Example 4 | Magnetite particles 2 | Methyl trimethoxysilane | 1.5 |
| Example 5 | Magnetite particles 3 | Dimethyl dimethoxysilane | 0.5 |
| Example 6 | Magnetite particles 4 | Phenyl triethoxysilane | 1.5 |
| Example 7 | Magnetite particles 5 | Isobutyl trimethoxysilane | 2.0 |
| Example 8 | Magnetite particles 6 | Methylhydrogen polysiloxane | 1.0 |
| Comparative Example 1 | Magnetite particles 1 | — | — |
| Comparative Example 2 | Magnetite particles 1 | Methyl triethoxysilane | 1.0 |
| Comparative Example 3 | Magnetite particles 1 | Methyl triethoxysilane | 0.005 |
| Comparative Example 4 | Magnetite particles 1 | Methyl triethoxysilane | 1.0 |

| | Production of magnetic composite particles Coating step with alkoxysilane or polysiloxanes | | | |
|---|---|---|---|---|
| | Edge runner treatment | | | Coating amount (calculated as Si) |
| | Linear load | | Time | |
| | (N/cm) | (Kg/cm) | (min.) | (wt. %) |
| Example 3 | 588 | 60 | 20 | 0.30 |
| Example 4 | 441 | 45 | 30 | 0.31 |

TABLE 5-continued

| Examples and Comparative Examples | | | | |
|---|---|---|---|---|
| Example 5 | 441 | 45 | 20 | 0.12 |
| Example 6 | 588 | 60 | 30 | 0.18 |
| Example 7 | 490 | 50 | 30 | 0.30 |
| Example 8 | 294 | 30 | 20 | 0.42 |
| Comparative Example 1 | — | — | — | — |
| Comparative Example 2 | 588 | 60 | 20 | 0.15 |
| Comparative Example 3 | 588 | 60 | 20 | $6 \times 10^{-4}$ |
| Comparative Example 4 | 588 | 60 | 20 | 0.15 |

| | Production of magnetic composite articles Adhesion step with organic blue-based pigment Organic blue-based pigment | |
|---|---|---|
| | Kind | Amount adhered (part by weight) |
| Example 3 | A | 10.0 |
| Example 4 | B | 15.0 |
| Example 5 | C | 20.0 |
| Example 6 | A | 25.0 |
| Example 7 | B | 15.0 |
| Example 8 | C | 5.0 |
| Comparative Example 1 | A | 10.0 |
| Comparative Example 2 | — | — |
| Comparative Example 3 | A | 10.0 |
| Comparative Example 4 | A | 0.1 |

| | Production of magnetic composite articles Adhesion step with organic blue-based pigment | | | |
|---|---|---|---|---|
| | Edge runner treatment | | | Amount adhered (calculated as C) |
| | Linear load | | Time | |
| | (N/cm) | (Kg/cm) | (min.) | (wt. %) |
| Example 3 | 588 | 60 | 30 | 6.00 |
| Example 4 | 588 | 60 | 20 | 8.61 |
| Example 5 | 588 | 60 | 30 | 11.03 |
| Example 6 | 441 | 45 | 20 | 13.22 |
| Example 7 | 441 | 45 | 30 | 8.59 |
| Example 8 | 441 | 45 | 30 | 3.08 |
| Comparative Example 1 | 588 | 60 | 20 | 6.59 |
| Comparative Example 2 | — | — | — | — |
| Comparative Example 3 | 588 | 60 | 20 | 6.58 |
| Comparative Example 4 | 588 | 60 | 20 | 0.06 |

TABLE 6

| Examples and Comparative Examples | Properties of magnetic composite particles | |
|---|---|---|
| | Average particle size (average major axial diameter ($\mu$m) | Sphericity (aspect ratio) (–) |
| Example 3 | 0.27 | — |
| Example 4 | 0.22 | 1.1:1 |
| Example 5 | 0.39 | 7.5:1 |

TABLE 6-continued

| Examples and Comparative Examples | | |
|---|---|---|
| Example 6 | 0.28 | — |
| Example 7 | 0.22 | 1.1:1 |
| Example 8 | 0.38 | 7.5:1 |
| Comparative Example 1 | 0.27 | — |
| Comparative Example 2 | 0.27 | — |
| Comparative Example 3 | 0.27 | — |
| Comparative Example 4 | 0.27 | — |

| | Properties of magnetic composite particles | | |
|---|---|---|---|
| | Geometrical standard deviation value (–) | BET specific surface area value ($m^2/g$) | Volume reisitivity value ($\Omega \cdot cm$) |
| Example 3 | 1.50 | 6.3 | $8.1 \times 10^5$ |
| Example 4 | 1.41 | 9.2 | $7.6 \times 10^5$ |
| Example 5 | 1.56 | 28.8 | $4.8 \times 10^5$ |
| Example 6 | 1.50 | 6.8 | $9.3 \times 10^5$ |
| Example 7 | 1.41 | 10.3 | $2.6 \times 10^6$ |
| Example 8 | 1.56 | 29.5 | $5.8 \times 10^6$ |
| Comparative Example 1 | — | 16.2 | $1.6 \times 10^6$ |
| Comparative Example 2 | 1.50 | 5.6 | $1.2 \times 10^7$ |
| Comparative Example 3 | — | 14.3 | $1.9 \times 10^6$ |
| Comparative Example 4 | — | 8.1 | $8.3 \times 10^6$ |

| | Properties of magnetic composite particles Magnetic properties Coercive force value | |
|---|---|---|
| | (kA/m) | (Oe) |
| Example 3 | 8.2 | 103 |
| Example 4 | 5.1 | 64 |
| Example 5 | 28.3 | 356 |
| Example 6 | 8.0 | 101 |
| Example 7 | 5.0 | 63 |
| Example 8 | 28.2 | 354 |
| Comparative Example 1 | 8.2 | 103 |
| Comparative Example 2 | 8.3 | 104 |
| Comparative Example 3 | 8.2 | 103 |
| Comparative Example 4 | 8.3 | 104 |

| | Properties of magnetic composite particles | | |
|---|---|---|---|
| | Magnetic properties | | |
| | Saturation magnetization value (795.8 kA/m; 10 kOe) ($Am^2/kg$) | Residual magnetization value (795.8 kA/m; 10 kOe) ($Am^2/kg$) | Fluidity index (–) |
| Example 3 | 81.5 | 11.4 | 48 |
| Example 4 | 76.6 | 6.8 | 50 |
| Example 5 | 72.3 | 25.2 | 45 |
| Example 6 | 71.3 | 10.1 | 52 |
| Example 7 | 77.1 | 6.3 | 53 |
| Example 8 | 82.5 | 26.2 | 46 |
| Comparative Example 1 | 79.8 | 11.0 | 38 |

TABLE 6-continued

| Examples and Comparative Examples | | | |
|---|---|---|---|
| Comparative Example 2 | 85.0 | 11.6 | 35 |
| Comparative Example 3 | 79.9 | 11.1 | 38 |
| Comparative Example 4 | 84.8 | 11.5 | 36 |

| | Properties of magnetic composite particles Hue | | |
|---|---|---|---|
| | L* value (–) | a* value (–) | b* value (–) |
| Example 3 | 7.7 | −0.54 | −1.13 |
| Example 4 | 6.8 | −0.43 | −0.55 |
| Example 5 | 8.6 | −0.21 | 0.32 |
| Example 6 | 7.4 | −0.30 | −0.08 |
| Example 7 | 7.3 | −0.21 | −0.54 |
| Example 8 | 9.3 | −0.13 | 0.53 |
| Comparative Example 1 | 11.3 | 0.21 | 1.20 |
| Comparative Example 2 | 12.0 | 1.23 | 4.71 |
| Comparative Example 3 | 11.4 | 0.19 | 1.24 |
| Comparative Example 4 | 11.7 | 1.18 | 4.06 |

| | Properties of black magnetic composite particles | |
|---|---|---|
| | Light resistance (ΔE* value) (–) | Desorption percentage of organic blue-based pigment (%) |
| Example 3 | 3.9 | 5.8 |
| Example 4 | 3.0 | 6.5 |
| Example 5 | 3.6 | 7.2 |
| Example 6 | 2.0 | 4.1 |
| Example 7 | 1.8 | 3.6 |
| Example 8 | 2.5 | 3.2 |
| Comparative Example 1 | 7.0 | 68.3 |
| Comparative Example 2 | 7.0 | — |
| Comparative Example 3 | 6.8 | 43.6 |
| Comparative Example 4 | 6.9 | — |

TABLE 7

| Examples and Comparative Examples | Production of black magnetic toner | |
|---|---|---|
| | Kind | Amount blended (part by weight) |
| | Magnetic composite particles | |
| Example 9 | Example 3 | 45 |
| Example 10 | Example 4 | 45 |
| Example 11 | Example 5 | 40 |
| Example 12 | Example 6 | 50 |
| Example 13 | Example 7 | 45 |
| Example 14 | Example 8 | 40 |
| Comparative Example 5 | Magnetite particles 1 | 45 |
| Comparative Example 6 | Magnetite particles 2 | 45 |
| Comparative Example 7 | Magnetite particles 3 | 45 |

TABLE 7-continued

| Examples and Comparative Examples | Production of black magnetic toner | |
|---|---|---|
| | Kind | Amount blended (part by weight) |
| Comparative Example 8 | Comparative Example 1 | 45 |
| Comparative Example 9 | Comparative Example 2 | 45 |
| Comparative Example 10 | Comparative Example 3 | 45 |
| Comparative Example 11 | Comparative Example 4 | 45 |
| | Binder resin | |
| Example 9 | Styrene-acrylic copolymer resin | 55 |
| Example 10 | Styrene-acrylic copolymer resin | 55 |
| Example 11 | Styrene-acrylic copolymer resin | 60 |
| Example 12 | Styrene-acrylic copolymer resin | 50 |
| Example 13 | Styrene-acrylic copolymer resin | 55 |
| Example 14 | Styrene-acrylic copolymer resin | 60 |
| Comparative Example 5 | Styrene-acrylic copolymer resin | 55 |
| Comparative Example 6 | Styrene-acrylic copolymer resin | 55 |
| Comparative Example 7 | Styrene-acrylic copolymer resin | 55 |
| Comparative Example 8 | Styrene-acrylic copolymer resin | 55 |
| Comparative Example 9 | Styrene-acrylic copolymer resin | 55 |
| Comparative Example 10 | Styrene-acrylic copolymer resin | 55 |
| Comparative Example 11 | Styrene-acrylic copolymer resin | 55 |

TABLE 8

| Examples and Comparative Examples | Properties of black magnetic toner | |
|---|---|---|
| | Average particle size (μm) | Dispersibility (–) |
| Example 9 | 9.8 | 5 |
| Example 10 | 10.1 | 5 |
| Example 11 | 10.0 | 5 |
| Example 12 | 9.9 | 5 |
| Example 13 | 9.7 | 5 |
| Example 14 | 9.9 | 5 |
| Comparative Example 5 | 10.0 | 3 |
| Comparative Example 6 | 10.3 | 3 |
| Comparative Example 7 | 10.0 | 3 |
| Comparative Example 8 | 10.1 | 2 |
| Comparative Example 9 | 9.9 | 3 |
| Comparative Example 10 | 9.8 | 2 |
| Comparative Example 11 | 9.9 | 2 |

| | Fluidity index (–) | Volume reisitivity value (Ω · cm) |
|---|---|---|

TABLE 8-continued

| Examples and Comparative Examples | Properties of black magnetic toner | |
|---|---|---|
| Example 9 | 77 | $1.5 \times 10^{14}$ |
| Example 10 | 79 | $5.8 \times 10^{14}$ |
| Example 11 | 71 | $1.8 \times 10^{14}$ |
| Example 12 | 83 | $9.6 \times 10^{13}$ |
| Example 13 | 86 | $1.1 \times 10^{14}$ |
| Example 14 | 73 | $2.4 \times 10^{14}$ |
| Comparative Example 5 | 60 | $6.9 \times 10^{12}$ |
| Comparative Example 6 | 64 | $6.8 \times 10^{12}$ |
| Comparative Example 7 | 59 | $7.3 \times 10^{11}$ |
| Comparative Example 8 | 63 | $2.1 \times 10^{11}$ |
| Comparative Example 9 | 60 | $7.3 \times 10^{12}$ |
| Comparative Example 10 | 62 | $1.4 \times 10^{11}$ |
| Comparative Example 11 | 61 | $5.8 \times 10^{12}$ |

| | Magnetic properties Coercive force value | |
|---|---|---|
| | (kA/m) | (Oe) |
| Example 9 | 8.0 | 100 |
| Example 10 | 4.8 | 60 |
| Example 11 | 26.9 | 338 |
| Example 12 | 7.8 | 98 |
| Example 13 | 4.8 | 60 |
| Example 14 | 26.3 | 330 |
| Comparative Example 5 | 8.2 | 103 |
| Comparative Example 6 | 4.9 | 61 |
| Comparative Example 7 | 27.5 | 346 |
| Comparative Example 8 | 7.9 | 99 |
| Comparative Example 9 | 8.0 | 100 |
| Comparative Example 10 | 8.0 | 100 |
| Comparative Example 11 | 8.0 | 101 |

| | Magnetic properties Saturation magnetization value ($Am^2/kg$) | |
|---|---|---|
| | 795.8 kA/m (10 kOe) | 79.6 kA/m (1 kOe) |
| Example 9 | 36.8 | 25.4 |
| Example 10 | 34.9 | 26.3 |
| Example 11 | 33.2 | 26.5 |
| Example 12 | 33.4 | 26.3 |
| Example 13 | 34.8 | 26.6 |
| Example 14 | 36.3 | 26.6 |
| Comparative Example 5 | 37.1 | 30.3 |
| Comparative Example 6 | 34.7 | 30.6 |
| Comparative Example 7 | 36.8 | 30.3 |
| Comparative Example 8 | 34.6 | 26.3 |
| Comparative Example 9 | 36.3 | 26.2 |
| Comparative Example 10 | 34.9 | 26.3 |
| Comparative Example 11 | 37.3 | 26.6 |

TABLE 8-continued

| Examples and Comparative Examples | Properties of black magnetic toner | |
|---|---|---|
| | Magnetic properties Residual magnetization value ($Am^2/kg$) | |
| | 795.8 kA/m (10 kOe) | 79.6 kA/m (1 kOe) |
| Example 9 | 5.6 | 4.0 |
| Example 10 | 3.8 | 2.7 |
| Example 11 | 12.1 | 8.2 |
| Example 12 | 5.5 | 3.9 |
| Example 13 | 3.7 | 2.6 |
| Example 14 | 11.9 | 8.0 |
| Comparative Example 5 | 5.9 | 4.5 |
| Comparative Example 6 | 4.1 | 3.0 |
| Comparative Example 7 | 13.8 | 9.1 |
| Comparative Example 8 | 5.7 | 4.3 |
| Comparative Example 9 | 5.8 | 4.0 |
| Comparative Example 10 | 5.6 | 4.3 |
| Comparative Example 11 | 5.7 | 4.1 |

| | Hue | | | Light |
|---|---|---|---|---|
| | L* value (–) | a* value (–) | b* value (–) | resistance (ΔE* value) (–) |
| Example 9 | 8.2 | −0.53 | 0.23 | 3.3 |
| Example 10 | 7.4 | −0.40 | −0.23 | 2.7 |
| Example 11 | 8.6 | −0.18 | 0.71 | 3.1 |
| Example 12 | 7.9 | −0.29 | 0.48 | 1.6 |
| Example 13 | 7.8 | −0.21 | −0.33 | 1.1 |
| Example 14 | 9.5 | −0.12 | 0.65 | 2.0 |
| Comparative Example 5 | 12.9 | 0.75 | 2.07 | 7.1 |
| Comparative Example 6 | 12.4 | 1.03 | 2.88 | 6.5 |
| Comparative Example 7 | 15.4 | 1.82 | 3.19 | 9.3 |
| Comparative Example 8 | 12.0 | 1.30 | 0.65 | 6.7 |
| Comparative Example 9 | 13.2 | 2.01 | 2.44 | 6.8 |
| Comparative Example 10 | 12.2 | 1.30 | 0.71 | 6.5 |
| Comparative Example 11 | 12.8 | 2.13 | 1.99 | 6.6 |

TABLE 9

| | Properties of black magnetic composite particles precursor | | |
|---|---|---|---|
| Magnetic core particle | Particle shape | Average particle size (μm) | Sphericity (–) |
| Core particles 1 | Granular-shape | 0.21 | 1.3 |

| | Properties of black magnetic composite particles precursor | | |
|---|---|---|---|
| Magnetic core | Geometrical standard deviation | BET specific surface area | Volume reisitivity |

TABLE 9-continued

| particle | value (–) | value ($m^2/g$) | value (Ω • cm) |
|---|---|---|---|
| Core particles 1 | 1.45 | 12.7 | $1.1 \times 10^4$ |

| | Properties of black magnetic composite particles precursor | | | |
|---|---|---|---|---|
| Magnetic core particle | Amount adhered of carbon black (calculated as C (wt %)) | Desorption percentage of the carbon black (% by weight, calculated as C). | Magnetic properties Coercive force value (kA/m) | (Oe) |
| Core particles 1 | 12.88 | 7.5 | 4.5 | 56 |

| | Properties of magnetite particles | | |
|---|---|---|---|
| | Magnetic properties | | |
| Magnetic core particle | Saturation magnetization value (795.8 kA/m; 10 kOe) ($Am^2/kg$) | Residual magnetization value (795.8 kA/m; 10 kOe) ($Am^2/kg$) | Fluidity index (–) |
| Core particles 1 | 69.6 | 8.0 | 51 |

| | Properties of Magnetite articles | | | |
|---|---|---|---|---|
| Magnetic | Hue | | | Light (ΔE* value) |
| core particle | L* value (–) | a* value (–) | b* value (–) | resistance (–) |
| Core particles 1 | 7.2 | 0.81 | 3.60 | 4.4 |

TABLE 10

| | | Production of magnetic composite particles Coating step with alkoxysilane or polysiloxanes Additives | |
|---|---|---|---|
| Example | Kind of magnetic core particles | Kind | Amount added (part by weight) |
| Example 15 | Core particles 1 | Methyl triethoxysilane | 1.0 |

| | Production of magnetic composite particles Coating step with alkoxysilane or polysiloxanes | | | |
|---|---|---|---|---|
| | Edge runner treatment | | | Coating amount (calculated |
| | Linear load | | Time | as Si) |
| Example | (N/cm) | (Kg/cm) | (min.) | (wt. %) |
| Example 15 | 588 | 60 | 30 | 0.15 |

| | Production of magnetic composite particles Adhesion step with organic blue-based pigment | | |
|---|---|---|---|
| | Organic blue-based pigment | | |
| Example | Kind | Amount adhered (part by weight) | |
| Example 15 | A | 30.0 | |

| | Production of magnetic composite particles Adhesion step with organic blue-based pigment | | | |
|---|---|---|---|---|
| | Edge runner treatment | | | Amount adhered (calculated |
| | Linear load | | Time | as C) |
| Example | (N/cm) | (Kg/cm) | (min.) | (wt. %) |
| Example 15 | 588 | 60 | 20 | 15.22 |

TABLE 11

| | Properties of magnetic composite particles | |
|---|---|---|
| Example | Average particle size (μm) | Sphericity (–) |
| Example 15 | 0.22 | 1.4 |

| | Properties of magnetic composite particles | | |
|---|---|---|---|
| Example | Geometrical standard deviation value (–) | BET specific surface area value ($m^2/g$) | Volume reisitivity value (Ω • cm) |
| Example 15 | 1.45 | 13.6 | $1.4 \times 10^5$ |

| | Properties of magnetic composite particles Magnetic properties Coercive force value | |
|---|---|---|
| Example | (kA/m) | (Oe) |
| Example 15 | 4.2 | 53 |

| | Properties of magnetic composite particles | | |
|---|---|---|---|
| | Magnetic properties | | |
| Example | Saturation magnetization value (795.8 kA/m; 10 kOe) ($Am^2/kg$) | Residual magnetization value (795.8 kA/m; 10 kOe) ($Am^2/kg$) | Fluidity index (–) |
| Example 15 | 63.1 | 7.2 | 57 |

| | Properties of magnetic composite particles Hue | | |
|---|---|---|---|
| Example | L* value (–) | a* value (–) | b* value (–) |
| Example 15 | 7.0 | –0.27 | –0.66 |

| | Properties of magnetic composite particles | |
|---|---|---|
| | Light resistance | Desorption percentage |

TABLE 11-continued

| Example | (ΔE* value) (–) | of phthalocyanine blue (%) |
|---|---|---|
| Example 15 | 2.5 | 7.0 |

TABLE 12

| | Production of black magnetic toner Magnetic composite particles | |
|---|---|---|
| Example | Kind | Amount blended (part by weight) |
| Example 16 | Example 15 | 45 |
| | Production of black magnetic toner Binder resin | |
| Example | Kind | Amount blended (part by weight) |
| Example 16 | Styrene-acrylic copolymer resin | 55 |

TABLE 13

| | Properties of black magnetic toner | |
|---|---|---|
| Example | Average particle size (μm) | Dispersibility (–) |
| Example 16 | 9.9 | 5 |
| | Properties of black magnetic toner | |
| Example | Fluidity index (–) | Volume reisitivity value (Ω • cm) |
| Example 16 | 80 | $8.2 \times 10^{13}$ |
| | Properties of black magnetic toner Magnetic properties Coercive force value | |
| Example | (kA/m) | (Oe) |
| Example 16 | 4.1 | 51 |
| | Properties of black magnetic toner Magnetic properties Saturation magnetization value ($Am^2/kg$) | |
| Example | 795.8 kA/m (10 kOe) | 79.6 kA/m (1 kOe) |
| Example 16 | 29.8 | 22.6 |
| | Properties of black magnetic toner Magnetic properties Residual magnetization value ($Am^2kg$) | |
| Example | 795.8 kA/m (10 kOe) | 79.6 kA/m (1 kOe) |
| Example 16 | 4.2 | 3.3 |

| | Properties of black magnetic toner | | | |
|---|---|---|---|---|
| | Hue | | | Light resistance |
| Example | L* value (–) | a* value (–) | b* value (–) | (ΔE* value) (–) |
| Example 16 | 7.3 | −0.28 | 0.65 | 2.3 |

What is claimed is:

1. Magnetic composite particles having an average particle diameter of 0.06 to 1.0 μm and a coercive force value of less than 39.790 kA/m, comprising:

magnetic core particles, a coating formed on surface of said magnetic core particles, comprising at least one organosilicon compound selected from the group consisting of:

(1) organosilane compounds obtainable from alkoxysilane compounds, and (2) polysiloxanes or modified polysiloxanes, and an organic blue-based pigment coat formed on said coating layer comprising said organosilicon compound, in an amount of from 1 to 50 parts by weight based on 100 parts by weight of said magnetic core particles.

2. Magnetic composite particles according to claim 1, wherein said magnetic core particles are (A) magnetite particles and (B) black magnetic composite particles precursor comprising:

magnetic iron oxide particles;

a coating formed on the surface of said magnetic iron oxide particles, comprising at least one organosilicon compound selected from the group consisting of:

(1) organosilane compounds obtainable from alkoxysilane compounds, and (2) polysiloxanes or modified polysiloxanes, and a carbon black coat formed on at least a part of the surface of said coating layer comprising said organosilicon compound, in an amount of 1 to 25 parts by weight based on 100 parts by weight of the said magnetic iron oxide particles.

3. Magnetic composite particles according to claim 1, wherein said magnetite particles or magnetic iron oxide particles are particles having a coat formed on at least a part of the surface of said magnetite particles or magnetic iron oxide particles and which comprises at least one compound selected from the group consisting of hydroxides of aluminum, oxides of aluminum, hydroxides of silicon and oxides of silicon in an amount of 0.01 to 20% by weight, calculated as Al or $SiO_2$, based on the total weight of the magnetite particles or magnetic iron oxide particles coated.

4. Magnetic composite particles according to claim 1, wherein said modified polysiloxanes are compounds selected from the group consisting of:

(A) polysiloxanes modified with at least one compound selected from the group consisting of polyethers, polyesters and epoxy compounds, and (B) polysiloxanes whose molecular terminal is modified with at least one group selected from the group consisting of carboxylic acid groups, alcohol groups and a hydroxyl group.

5. Magnetic composite particles according to claim 4, wherein said polysiloxanes modified with at least one compound selected from the group consisting of polyethers, polyesters and epoxy compounds are represented by the general formula (III), (IV) or (V):

(III)

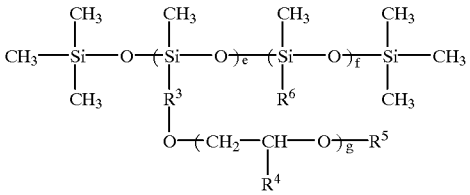

wherein $R^3$ is $—(—CH_2—)_h—$; $R^4$ is $—(—CH_2—)_i—CH_3$; $R^5$ is —OH, —COOH, $—CH=CH_2$, $—C(CH_3)=CH_2$ or $—(—CH_2—)_j—CH_3$; $R^6$ is $—(—CH_2—)_k—CH_3$; g and h are an integer of 1 to 15; i, j and k are an integer of 0 to 15; e is an integer of 1 to 50; and f is an integer of 1 to 300;

(IV)

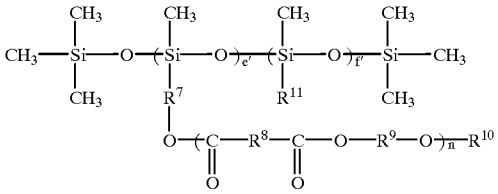

wherein $R^7$, $R^8$ and $R^9$ are $—(—CH_2—)_q—$ and may be the same or different; $R^{10}$ is —OH, —COOH, $—CH=CH_2$, $—C(CH_3)=CH_2$ or $—(—CH_2—)_r—CH_3$; $R^{11}$ is $—(—CH_2—)_s—CH_3$; n and q are an integer of 1 to 15; r and s are an integer of 0 to 15; e' is an integer of 1 to 50; and f' is an integer of 1 to 300; or (V)

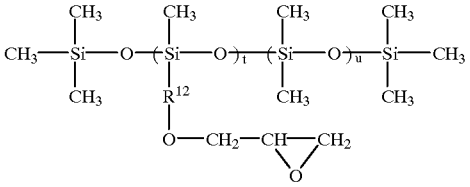

wherein $R^{12}$ is $—(—CH_2—)_v—$; v is an integer of 1 to 15; t is an integer of 1 to 50; and u is an integer of 1 to 300.

6. Magnetic composite particles according to claim 4, wherein said polysiloxanes whose molecular terminal is modified with at least one group selected from the group consisting of carboxylic acid groups, alcohol groups and a hydroxyl group are represented by the general formula (VI):

(VI)

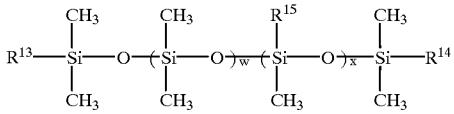

wherein $R^{13}$ and $R^{14}$ are —OH, $R^{16}OH$ or $R^{17}COOH$ and may be the same or different; $R^{15}$ is $—CH_3$ or $—C_6H_5$; $R^{16}$ and $R^{17}$ are $—(—CH_2—)_y—$; y is an integer of 1 to 15; w is an integer of 1 to 200; and x is an integer of 0 to 100.

7. Magnetic composite particles according to claim 1, wherein said alkoxysilane compound is represented by the general formula (I):

$$R^1{}_aSiX_{4-a} \quad (I)$$

wherein $R^1$ is $C_6H_5$—, $(CH_3)_2CHCH_2$— or n-$C_bH_{2b+1}$— (wherein b is an integer of 1 to 18); X is $CH_3O$—or $C_2H_5O$—; and a is an integer of 0 to 3.

8. Magnetic composite particles according to claim 7, wherein said alkoxysilane compound is methyltriethoxysilane, dimethyldiethoxysilane, phenyltriethoxysilane, diphenyldiethoxysilane, methyltrimethoxysilane, dimethyldimethoxysilane, phenyltrimethoxysilane, diphenyldimethoxysilane, isobutyltrimethoxysilane or decyltrimethoxysilane.

9. Magnetic composite particles according to claim 1, wherein said polysiloxanes are represented by the general formula (II):

(II)

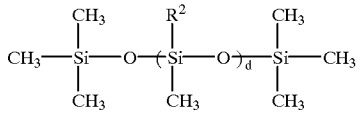

wherein $R^2$ is H— or $CH_3$—, and d is an integer of 15 to 450.

10. Magnetic composite particles according to claim 1, wherein the amount of said coating organosilicon compounds is 0.02 to 5.0% by weight, calculated as Si, based on the total weight of the organosilicon compounds and said magnetite particles or magnetic iron oxide particles.

11. Magnetic composite particles according to claim 1, wherein said magnetic composite particles have a BET specific surface area value of 1.0 to 100 $m^2/g$, a geometrical standard deviation of the particle size of 1.01 to 2.0, a fluidity index of 44 to 90, and a volume resistivity value of not less than $7.0\times10^4$ Ω·cm.

12. Magnetic composite particles according to claim 1, wherein said magnetic composite particles have a L* value of 2.0 to 13.5, an a* value of −2.0 to 0.0, a b* value thereof of −3.0 to 5.5, and a light resistance (ΔE* value) of not more than 5.0.

13. Magnetic composite particles according to claim 1, wherein said magnetic composite particles have a coercive force value of 0.8 to 31.8 kA/m; a saturation magnetization value in a magnetic field of 795.8 kA/m of 50 to 91 $Am^2/kg$; and a residual magnetization value in a magnetic field of 795.8 kA/m of 1 to 35 $Am^2/kg$.

14. Magnetic composite particles according to claim 1, wherein said organic blue-based pigment is a phthalocyanine-based pigment and an alkali blue pigment.

15. A process for producing said magnetic composite particles defined in claim 1, which process comprises:

mixing magnetic core particles together with at least one compound selected from the group consisting of:

(1) alkoxysilane compounds, and (2) polysiloxanes or modified polysiloxanes, by using an apparatus capable of applying a shear force to the magnetic core particles, thereby coating the surface of said magnetic core particle with the said compounds;

mixing the obtained magnetic core particles coated with the said compounds and an organic blue-based pigments in an amount of 1 to 50 parts by weight based on 100 parts by weight of the magnetic core particles by using an apparatus capable of applying a shear force to the magnetic core particles coated with said compound, thereby forming an organic blue-based pigments coat on the surface of a coating layer comprising the organosilicon compounds.

16. A process for producing magnetic composite particles according to claim 15, wherein said magnetic core particles are (A) magnetite particles and (B) black magnetic composite particles precursor comprising:

magnetic iron oxide particles;

a coating formed on the surface of said magnetic iron oxide particles, comprising at least one organosilicon compound selected from the group consisting of:

(1) organosilane compounds obtainable from alkoxysilane compounds, and (2) polysiloxanes or modified polysiloxanes, and a carbon black coat formed on at least a part of the surface of said coating layer comprising said organosilicon compound, in an amount of 1 to 25 parts by weight based on 100 parts by weight of the said magnetic iron oxide particles.

17. A process for producing magnetic composite particles according to claim 15, wherein said magnetite particles or magnetic iron oxide particles are coated with at least one compound selected from the group consisting of hydroxides of aluminum, oxides of aluminum, hydroxides of silicon and oxides of silicon.

18. Black magnetic toner comprising:

a binder resin, and magnetic composite particles having an average particle diameter of 0.06 to 1.0 μm and a coercive force value of less than 39.790 kA/m, comprising:

magnetic core particles, a coating formed on surface of said magnetic core particles, comprising at least one organosilicon compound selected from the group consisting of:

(1) organosilane compounds obtainable from alkoxysilane compounds, and (2) polysiloxanes or modified polysiloxanes, and an organic blue-based pigment coat formed on said coating layer comprising said organosilicon compound, in an amount of from 1 to 50 parts by weight based on 100 parts by weight of said magnetic core particles.

19. Black magnetic toner according to claim 18, wherein the amount of the binder resin is 50 to 900 parts by weight based on 100 parts by weight of the magnetic composite particles.

20. Black magnetic toner according to claim 18, which further comprises an average particle size of 3 to 15 μm.

21. Black magnetic toner according to claim 18, which further comprises a flowability index of 70 to 100 and a volume resistivity of not less than $1.0\times10^{13}$ Ω·cm.

22. Black magnetic toner according to claim 18, which further comprises a blackness (L* value) of 2.0 to 13.5, an a* value of −2.0 to 0.0, a b* value of −3.0 to 5.5 and a light resistance (ΔE* value) of not more than 5.0.

23. Black magnetic toner according to claim 18, which further comprises a coercive force value of 0.8 to 31.8 kA/m, a saturation magnetization value of 10 to 85 $Am^2/kg$ and a residual magnetization value of 1 to 20 $Am^2/kg$ when measured in a magnetic field of 795.8 kA/m; and a saturation magnetization value of usually 7.5 to 65 $Am^2/kg$ and a residual magnetization value of 0.5 to 15 $Am^2/kg$ when measured in a magnetic field of 79.6 kA/m.

24. Black magnetic toner according to claim 18, wherein said magnetic core particles are (A) magnetite particles and (B) black magnetic composite particles precursor comprising:

magnetic iron oxide particles;

a coating formed on the surface of the said magnetic iron oxide particles, comprising at least one organosilicon compound selected from the group consisting of:

(1) organosilane compounds obtainable from alkoxysilane compounds, and (2) polysiloxanes or modified polysiloxanes, and a carbon black coat formed on at least a part of the surface of the said coating layer comprising the said organosilicon compound, in an amount of 1 to 25 parts by weight based on 100 parts by weight of the said magnetic iron oxide particles.

25. Black magnetic toner according to claim 18, wherein said magnetite particles or magnetic iron oxide particles are particles having a coat which is formed on at least a part of the surface of said magnetite particles or magnetic iron oxide particles and which comprises at least one compound selected from the group consisting of hydroxides of aluminum, oxides of aluminum, hydroxides of silicon and oxides of silicon in an amount of 0.01 to 20% by weight, calculated as Al or $SiO_2$, based on the total weight of the magnetite particles or magnetic iron oxide particles.

26. Black magnetic toner according to claim 18, wherein the amount of said coating organosilicon compounds is 0.02 to 5.0% by weight, calculated as Si, based on the total weight of the organosilicon compounds and said magnetite particles or magnetic iron oxide particles.

27. Magnetic composite particles comprising:

magnetic core particles, a coating formed on surface of said magnetic core particles, comprising at least one organosilicon compound selected from the group consisting of:

(1) organosilane compounds obtainable from alkoxysilane compounds, and (2) polysiloxanes or modified polysiloxanes, and an organic blue-based pigment coat formed on said coating layer comprising said organosilicon compound, in an amount of from 1 to 50 parts by weight based on 100 parts by weight of said magnetic core particles; and having an average particle diameter of 0.06 to 1.0 μm, a BET specific surface area value of 1.0 to 100 $m^2/g$, a geometrical standard deviation of the particle size of 1.01 to 2.0, a L* value of 2.0 to 13.5, an a* value of −2.0 to 0.0, a b* value of −3.0 to 5.5, and a coercive force value of less than 39.790 kA/m.

28. Black magnetic toner comprising:

a binder resin, and magnetic composite particles having an average particle diameter of 0.06 to 1.0 μm and a coercive force value of less than 39.790 kA/m, comprising:

magnetic core particles, a coating formed on surface of said magnetic core particles, comprising at least one organosilicon compound selected from the group consisting of:

(1) organosilane compounds obtainable from alkoxysilane compounds, and (2) polysiloxanes or modified polysiloxanes, and an organic blue-based pigment coat formed on said coating layer comprising said organosilicon compound, in an amount of from 1 to 50 parts by weight based on 100 parts by weight of said magnetic core particles; and having an average particle size of 3 to 15 μm, a flowability index of 70 to 100, a volume resistivity of not less than $1.0\times10^{13}$ Ω·cm, a blackness (L* value) of 2.0 to 13.5, an a* value of −2.0 to 0.0, a b* value of −3.0 to 5.5, a light resistance (ΔE* value) of not more than 5.0, and a coercive force value of less than 39.790 kA/m.

* * * * *